US009195174B2

(12) United States Patent
Kobayashi et al.

(10) Patent No.: US 9,195,174 B2
(45) Date of Patent: Nov. 24, 2015

(54) IMAGE FORMING APPARATUS WITH CONTROL OF POTENTIAL AT TRANSFER PORTION

(71) Applicant: CANON KABUSHIKI KAISHA, Tokyo (JP)

(72) Inventors: Shinsuke Kobayashi, Yokohama (JP); Keisuke Ishizumi, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 14/095,213

(22) Filed: Dec. 3, 2013

(65) Prior Publication Data

US 2014/0153946 A1 Jun. 5, 2014

(30) Foreign Application Priority Data

Dec. 4, 2012 (JP) ..... 2012-265760

(51) Int. Cl.
*G03G 15/16* (2006.01)

(52) U.S. Cl.
CPC ..... *G03G 15/1605* (2013.01); *G03G 15/168* (2013.01); *G03G 15/1675* (2013.01); *G03G 15/161* (2013.01); *G03G 2215/0132* (2013.01)

(58) Field of Classification Search
CPC ..... G03G 15/5004; G03G 15/1675; G03G 15/168; G03G 15/161; G03G 21/0005; G03G 2215/1647; G03G 2215/1661; G03G 15/1605; G03G 2215/0132
USPC ..... 399/66, 71, 101, 88, 43
See application file for complete search history.

(56) References Cited

U.S. PATENT DOCUMENTS

| | | | | |
|---|---|---|---|---|
| 6,173,135 | B1 * | 1/2001 | Yuminamochi et al. | 399/66 |
| 6,473,574 | B1 * | 10/2002 | Usui et al. | 399/66 |
| 6,845,222 | B2 | 1/2005 | Takai | |
| 7,596,331 | B2 * | 9/2009 | Kinokuni | |
| 2005/0025507 | A1 * | 2/2005 | Ishii et al. | 399/27 |
| 2012/0113442 | A1 * | 5/2012 | Kyung et al. | 358/1.9 |
| 2012/0219315 | A1 * | 8/2012 | Suzuki et al. | 399/101 |
| 2012/0230705 | A1 * | 9/2012 | Shimura et al. | 399/26 |

FOREIGN PATENT DOCUMENTS

| | | | |
|---|---|---|---|
| JP | 6-83176 | A | 3/1994 |
| JP | 11-102145 | A | 4/1999 |
| JP | 2004-85976 | A | 3/2004 |
| JP | 2004-117572 | A | 4/2004 |

* cited by examiner

*Primary Examiner* — Sophia S Chen
(74) *Attorney, Agent, or Firm* — Fitzpatrick, Cella, Harper & Scinto

(57) ABSTRACT

The image forming apparatus includes a control unit that controls the potential at a transfer portion of a rotary member to be a potential of the same polarity as the charged polarity of the toner at development, when an image forming apparatus starts rotating a photosensitive member, after the start of output by a common power supply and before a charge area on the photosensitive member reaches the transfer portion.

13 Claims, 19 Drawing Sheets

IMAGE FORMING APPARATUS WITH CONTROL OF POTENTIAL AT TRANSFER PORTION

BACKGROUND OF THE INVENTION

1. Field of the Invention

The present invention relates to an image forming apparatus, such as a printer, a copying machine and a facsimile machine, using an electrophotographic system.

2. Description of the Related Art

Conventionally, an image forming apparatus of an electrophotographic system generally forms a toner image through processes of charging a photosensitive member, exposing, and developing and ultimately transfers the toner image to a recording material to form an image on the recording material.

FIG. 24A schematically illustrates the surrounding of a drum-type photosensitive member (photosensitive drum) included in a conventional image forming apparatus of the electrophotographic system. At the image formation, a charging device 202 substantially uniformly charges the surface of a photosensitive drum 201. The charging device 202 is connected to a high voltage power supply for charging. An exposure device 203, such as a laser scanner and an LED, exposes the surface of the charged photosensitive drum 201 based on image data. A developing unit 204 uses toner t to develop (visualize) a toner image from an electrostatic latent image formed on the photosensitive drum 201. The developing unit 204 is connected to a high voltage power supply for developing. A voltage with opposite polarity to the charged polarity of the toner at the time of development is applied to a transfer device 205 to transfer the toner image formed on the photosensitive drum 201 to a transferred body r. The transfer device 205 is connected to a high voltage power supply for transferring (not illustrated).

A color image forming apparatus repeats the processes up to the transfer for toners of, for example, four colors, yellow (Y), magenta (M), cyan (C) and black (Bk), and superimposes the color toner images. The transferred body r is a recording material, such as paper, carried by a recording material carrier in a direct transfer system. The transferred body r is an intermediate transfer member in an intermediate transfer system.

Japanese Patent Application Laid-Open No. H11-102145 discloses an image forming apparatus of an electrophotographic system that applies voltage from one high voltage power supply (common power supply) to a charging device and a developing device in order to downsize the apparatus. The image forming apparatus of Japanese Patent Application Laid-Open No. H11-102145 includes one high voltage power supply that can apply AC voltage of a rectangular wave at a predetermined duty ratio to a charging device and a developing unit that is not in contact with the photosensitive drum.

However, the configuration of applying voltage (voltage for charging and/or developing) from the common power supply to the charging device and the developing device has the following problem.

As illustrated in FIG. 24B, when voltage is applied from the common power supply to the charging device and the developing device, the voltage is also applied to the developing device at the start of initial operation of the image forming apparatus, at the same time as the application of the voltage to the charging device. The "initial operation" denotes initial operation after the control is reset, such as when the main power supply of the image forming apparatus is turned on and when there is a paper jam (jam).

Therefore, if the developing device 204 is in contact with the photosensitive drum 201, the following occurs when the application of the voltage is started. More specifically, the voltage is applied to the developing unit 204 that is in contact with a section of the surface of the photosensitive drum 201 that is not charged, in a time period in which the surface of the photosensitive drum 1 moves in a section A from a charge section Nc to a developing portion Nd after the start of the application of the voltage.

Therefore, the toner t is electrostatically pulled toward the photosensitive drum 201 in a section A' on the photosensitive drum 201 that passes through the developing portion Nd in a time period in which the surface of the photosensitive drum 201 moves in the section A. The entire surface of the photosensitive drum 1 at the section is developed.

The amount of toner at the section A' depends on the state of the surface potential of the photosensitive drum 201. For example, when the surface potential of the photosensitive drum 201 is substantially the same potential as the earth (around 0 V), the section A' is developed by toner substantially at 100% density. The toner is further transferred from the surface of the photosensitive drum 201 to the transferred body r. The toner may cause a defect in the image transferred to the recording material. For example, if the transferred body r is an intermediate transfer member, the toner is adhered to an unintended part of the image. If the transferred body r is a recording material carrier, unintended toner is adhered to the back surface of the recording material or to a first surface in double-sided printing.

SUMMARY OF THE INVENTION

An object of the present invention is to provide an image forming apparatus that can prevent a defect caused by toner adhered to a photosensitive member at the start of application of voltage from a common power supply that applies voltage to a charging device and a developing device.

Another object of the present invention is to provide image forming apparatus including a rotatable photosensitive member, a charging device that charges the photosensitive member, an exposure device that exposes the charged photosensitive member to form an electrostatic latent image on the photosensitive member, a developing device that supplies toner to the photosensitive member to develop an electrostatic latent image on the photosensitive member as a toner image, a common power supply that applies voltage to the charging device and the developing device, a movable rotary member that forms a transfer portion with the photosensitive member to receive the toner image from the photosensitive member or to convey a recording material that receives the toner image, and a control unit that controls potential at the transfer portion of the rotary member, wherein when the photosensitive member starts rotating, during a period after the common power supply starts outputting and before a charge area charged by the charging device on the photosensitive member reaches the transfer portion, the control unit controls the potential at the transfer portion of the rotary member to be a potential of same polarity as charged polarity of the toner at development.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, an image forming apparatus according to the present invention will be described in further detail with reference to the drawings.

First Embodiment

1. Overall Configuration and Operation of Image Forming Apparatus

Figure 1:
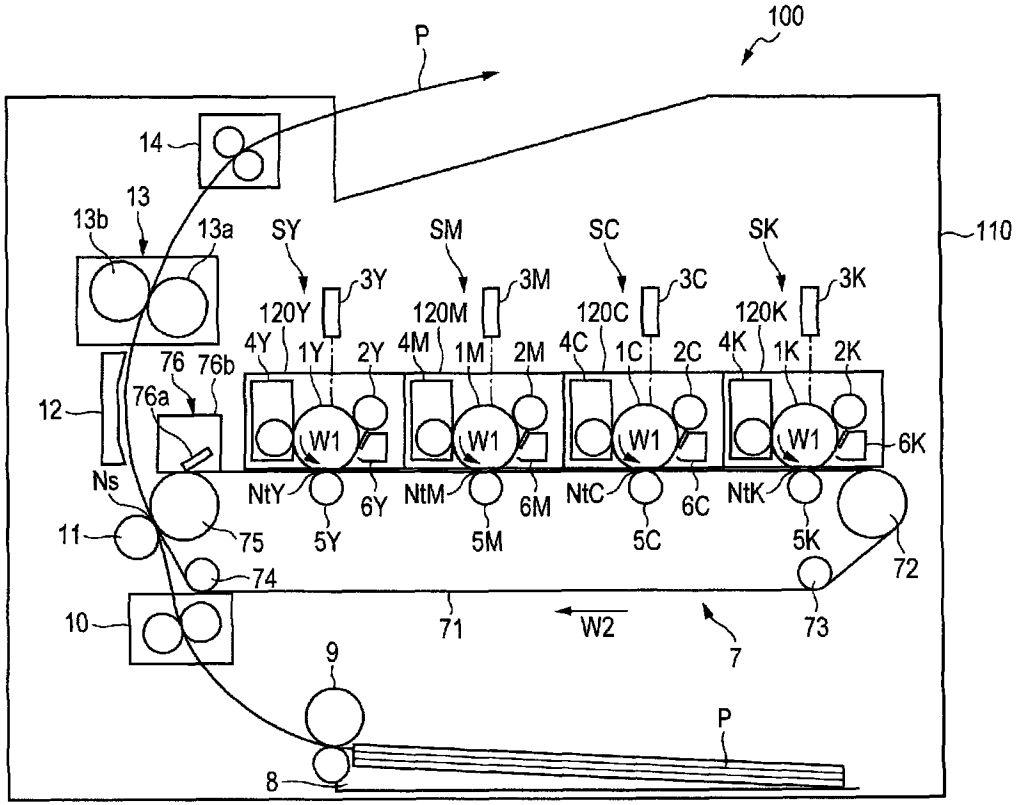
FIG. 1 is a schematic cross-sectional view of an image forming apparatus according to a first embodiment.

FIG. 1 is a schematic cross-sectional view of an image forming apparatus according to an embodiment of the present invention. An image forming apparatus 100 of the present embodiment is a laser beam printer adopting a 4-drum system (in-line system) and an intermediate transfer system, the printer capable of using an electrophotographic system to form a full-color image.

The image forming apparatus 100 includes four image forming units (stations) SY, SM, SC and SK. The image forming units (stations) SY, SM, SC and SK form images of yellow (Y), magenta (M), cyan (C) and black (K), respectively.

In the present embodiment, configurations and operation of the image forming units SY, SM, SC and SK are substantially the same, except that the colors used in the toner are different. Therefore, Y, M, C and K at the ends of the reference numerals indicative of elements of the image forming units SY, SM, SC and SK are omitted when the distinction is not particularly necessary, and the elements will be described as a whole. The image forming units SY, SM and SC for yellow, magenta and cyan will be collectively called color image forming units SY, SM and SC.

Figure 2:
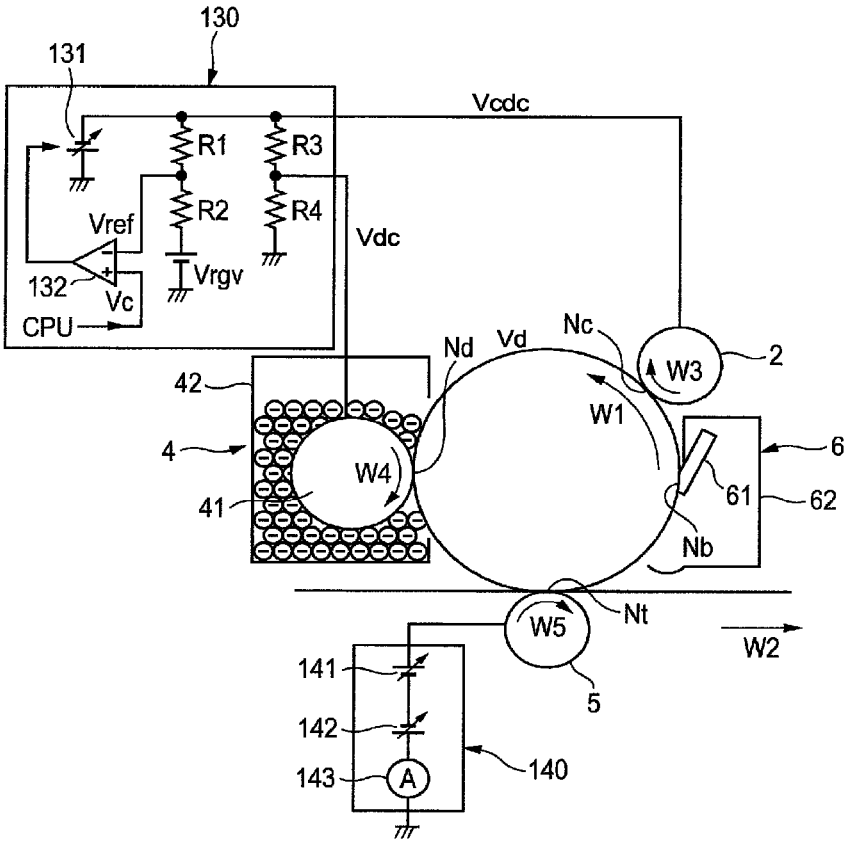
FIG. 2 is a schematic diagram illustrating more details of a configuration of an image forming unit of the image forming apparatus according to the first embodiment.

The image forming unit S includes a photosensitive drum 1 that is a drum-type electrophotographic photosensitive member (photosensitive member) as an image carrier. A main motor 111 (FIG. 3) as a driving source transmits driving force to the photosensitive drum 1, and the photosensitive drum 1 is rotated and driven in an arrow W1 direction in FIG. 1. The following devices are arranged in the rotation direction around the photosensitive drum 1. A charging roller 2 as a charging device that uniformly charges the photosensitive drum 1 is arranged. An exposure device 3 (laser scanner) that emits light to the photosensitive drum 1 according to an image signal to form an electrostatic latent image (electrostatic image) on the photosensitive drum 1 is arranged. A developing device 4 that attaches the toner to the electrostatic latent image on the photosensitive drum 1 to form a toner image is arranged. A primary transfer roller 5 as a primary transfer device that primarily transfers the toner image on the photosensitive drum 1 to an intermediate transfer belt 71 as a transferred body is arranged. A drum cleaner 6 that collects the toner (primary transfer remaining toner) remained on the photosensitive drum after the primary transfer process is arranged. The developing device 4 includes a developing roller 41 as a developer carrier and a development container 42 that houses the toner as a developer (FIG. 2). The drum cleaner 6 includes a drum cleaning blade 61 as a cleaning member and a cleaning container 62 that houses the collected toner (FIG. 2).

An intermediate transfer unit 7 facing the photosensitive drums 1 of the image forming units S is also arranged. The intermediate transfer unit 7 includes the intermediate transfer belt 71 as an intermediate transfer member that is a rotary member coming into contact with the photosensitive drums 1 to rotate and move, the intermediate transfer belt 71 facing the photosensitive drums 1 of the image forming units S. The intermediate transfer belt 71 is an endless belt and is stretched by a driving roller 72, a tension roller 73, an idler roller 74 and a secondary transfer opposing roller 75. The driving force from the main motor 111 (FIG. 3) is transmitted to the driving roller 72, and the driving roller 72 rotates and drives the intermediate transfer belt 71 in an arrow W2 direction in FIG. 1.

The primary transfer rollers 5 are arranged on the inner side of the intermediate transfer belt 71, at positions facing the photosensitive drums 1. The primary transfer roller 5 is pressed against the photosensitive drum 1 through the intermediate transfer belt 71 to form a primary transfer portion (primary transfer nip) Nt where the intermediate transfer belt 71 and the photosensitive drum 1 come into contact. A secondary transfer roller 11 as a secondary transfer device is arranged on the outer side of the intermediate transfer belt 71, at a position facing the secondary transfer opposing roller 75. The secondary transfer roller 11 is pressed against the secondary transfer opposing roller 75 through the intermediate transfer belt 71 to form a secondary transfer portion (secondary transfer nip) Ns where the intermediate transfer belt 71 and the secondary transfer roller 11 come into contact. A belt cleaner 76 as an intermediate transfer member cleaning unit, which collects the toner (secondary transfer remaining toner) remained on the intermediate transfer belt 71 after the secondary transfer process, is arranged on the outer side of the intermediate transfer belt 71, at a position facing the secondary transfer opposing roller 75.

In the image formation, the charging roller 2 uniformly charges the outer surface of the rotating photosensitive drum 1, at a predetermined potential with a predetermined polarity. The charging roller 2 comes into contact with the photosensitive drum 1 and follows the rotation of the photosensitive drum 1 to rotate in an arrow W3 direction in FIG. 2. In this case, a voltage with a predetermined polarity (negative polarity in the present embodiment) is applied to the charging roller 2. The exposure device 3 scans and exposes the surface of the charged photosensitive drum 1 according to image information. As a result, an electrostatic latent image (electrostatic image) is formed on the photosensitive drum 1 according to the image information of color components corresponding to each image forming unit S. The developing device 4 develops a toner image from the electrostatic latent image formed on the photosensitive drum 1. As the developing roller 41 carries and conveys the toner housed in the development container 42, the developing device 4 supplies the toner to the photosensitive drum 1. The developing roller 41 receives driving force from the main motor 111 (FIG. 3) as a driving source to rotate and drive in an arrow W4 direction in FIG. 2. In this case, a voltage with a predetermined polarity (negative polarity in the present embodiment) is applied to the developing roller 41. In the present embodiment, the toner image is formed by image exposure and reverse development. More specifically, toner charged to the same polarity as the charged polarity of the photosensitive drum 1 is adhered to an exposed section on the photosensitive drum 1 with an absolute value of potential reduced by the exposure after uniform charging, and a toner image is formed. In the present embodiment, the charged polarity (regular charged polarity) of the toner at the time of development is negative polarity.

In the present embodiment, the developing roller 41 is always in contact with the photosensitive drum 1 at a predetermined pressure.

As described in detail later, a common power supply 130 (FIG. 2) as a common high voltage circuit supplies voltage to the charging roller 2 and the developing roller 41 of each image forming unit S. More specifically, the charge voltage applying unit and the development voltage applying unit share the high voltage circuit in each image forming unit S. High voltage control related to the common power supply 130 will be described in further detail later.

At a primary transfer portion Nt, the toner image formed on the photosensitive drum 1 is transferred (primary transfer) to the intermediate transfer belt 71 rotated at substantially the same speed as the photosensitive drum 1 based on the effect of the primary transfer roller 5. The primary transfer roller 5 comes into contact with the back side of the intermediate transfer belt 71 and follows the rotation of the intermediate transfer belt 71 to rotate in an arrow W5 direction in FIG. 2. In this case, a power supply for primary transfer 140 (FIG. 2) that is a high voltage power supply applies, to the primary transfer roller 5, a primary transfer voltage that is a DC voltage with the polarity (positive polarity in the present embodiment) opposite the charged polarity of the toner at the time of development. In the present embodiment, a primary transfer voltage of about +1 kV is applied to the primary transfer roller 5 at the image formation.

As described in detail later, the power supply for primary transfer 140 connected to the primary transfer roller 5 of each image forming unit S can independently apply voltage of both positive and negative polarities for each image forming unit S. High voltage control related to the power supply for primary transfer 140 will be described in further detail later.

For example, at the formation of a full-color image, the toner images formed on the photosensitive drums 1Y, 1M, 1C and 1K of the image forming units SY, SM, SC and SK are sequentially superimposed and transferred to the intermediate transfer belt 71. The toner images transferred to the intermediate transfer belt 71 move to the secondary transfer portion Ns along with the rotation of the intermediate transfer belt 71.

The drum cleaner 6 arranged on the downstream of the primary transfer portion Nt in the rotation direction of the photosensitive drum 1 collects the toner (primary transfer remaining toner) remained on the photosensitive drum 1 without being transferred to the intermediate transfer belt 71 at the primary transfer portion Nt. In the drum cleaner 6, the drum cleaning blade 61 arranged in contact with the photosensitive drum 1 scrapes off the primary transfer remaining toner from the rotating photosensitive drum 1, and the toner is collected in the cleaning container (collected toner container) 62.

Meanwhile, a recording material supplying roller 9 transports a recording material P loaded and stored in the recording material cassette 8 as a recording material storage, and the recording material P is conveyed to a nip section of a resist roller pair 10 and is temporarily stopped. The resist roller pair 10 supplies the temporarily stopped recording material P to the secondary transfer portion Ns, in synchronization with the timing that the toner image formed on the intermediate transfer belt 71 reaches the secondary transfer portion Ns.

At the secondary transfer portion Ns, the toner image formed on the intermediate transfer belt 71 is transferred (secondary transfer) to the recording material P conveyed between the intermediate transfer belt 71 and the secondary transfer roller 11, by the effect of the secondary transfer roller 11. In this case, a high voltage power supply for secondary transfer (not illustrated) applies, to the secondary transfer roller 11, a secondary transfer voltage as a DC voltage with polarity (positive polarity in the present embodiment) opposite the charged polarity of the toner at the time of development. In the present embodiment, a secondary transfer voltage of about +1.5 kV is applied to the secondary transfer roller 11 at the image formation.

The recording material P provided with the toner images are separated from the intermediate transfer belt 71 and transmitted through a conveyance guide 12 to a fixation apparatus 13 as a fixation unit. In the fixation apparatus 13, a fixation roller 13*a* and a pressure roller 13*b* heat and pressurize the recording material P, and the toner images are melted and fixed to the surface. As a result, a full-color image is obtained, for example. A recording material discharge roller pair 14 then discharges the recording material P to the outside of the apparatus, and one cycle of printing (image forming operation) is finished.

The belt cleaner 76 arranged on the downstream of the secondary transfer portion Ns in the rotation direction of the intermediate transfer belt 71 collects the toner (secondary transfer remaining toner) remained on the intermediate transfer belt 71 without being transferred to the recording material P at the secondary transfer portion Ns. In the belt cleaner 76 of the present embodiment, a belt cleaning blade 76*a* arranged in contact with the intermediate transfer belt 71 scrapes off the secondary transfer remaining toner from the rotating intermediate transfer belt 71, and the toner is collected in a cleaning container (collected toner container) 76*b*. The belt cleaning blade 76*a* is in contact with the intermediate transfer belt 71 on the downstream of the secondary transfer portion Ns and on the upstream of the primary transfer portion NtY of the uppermost yellow image forming unit SY, in the movement direction of the intermediate transfer belt 71.

In the present embodiment, the plurality of photosensitive drums 1 is arranged in series in the movement direction of the image transferred surface extending substantially horizontally to the intermediate transfer belt 71. The photosensitive drums 1 continuously transfer multiple toner images to the intermediate transfer belt 71, and a full-color print image is obtained.

In the present embodiment, the intermediate transfer belt 71 is rotated and driven at a peripheral velocity (process speed) of 115 mm/sec that is substantially the same speed as the peripheral velocity of the photosensitive drum 1. Examples of the material of the intermediate transfer belt 71 include resin materials, such as polyimide, polyamide, polycarbonate (PC), polyvinylidene fluoride (PVDF), polytetrafluoroethylene polymer (PTFE), polyethylene, polypropylene, polysulfone, polyarylate, polyethylene terephthalate, polyether sulfone, polyethylene naphthalate (PEN) and thermoplastic polyimide. Alternatively, the surface can be provided with an acrylic resin curing layer or a solid rubber elastic layer. In the present embodiment, an ion conductive agent is added to the intermediate transfer belt 71 to adjust the electric resistance. The volume resistivity is $1\times10^{10}$ Ω·cm. The thickness is 100 μm. The inner length is 700 mm.

The driving roller 72, the tension roller 73, the idler roller 74 and the secondary transfer opposing roller are support rollers that support the intermediate transfer belt 73. In the present embodiment, the driving roller 72 and the secondary transfer opposing roller 75 have a diameter of 24 mm, and the tension roller 73 and the idler roller 74 have a diameter of 16 mm.

In the present embodiment, the photosensitive drum 1, the charging roller 2 as a processing unit that acts on the photosensitive drum 1, the developing apparatus 4 and the drum cleaner 6 in each image forming unit S are integrated (unitized) into a process cartridge 120. Each process cartridge 120 can be independently attached to and detached from an apparatus main body 110 of the image forming apparatus 100. The user can individually take each process cartridge 120 in and out of the apparatus main body 110 to replace the cartridge with a new one when the toner is empty, for example.

2. High Voltage Circuit (High Voltage Control Circuit)

FIG. 2 is a schematic diagram illustrating the configuration of the image forming unit S in more detail. In the present embodiment, the configurations of the high voltage circuits in the image forming units SY, SM, SC and SK are substantially the same, and the common power supply 130 and the power supply for primary transfer 140 are independently arranged for each image forming unit S.

As illustrated in FIG. 2, the common power supply 130 is connected to the charging roller 2 and the developing roller 41. The common power supply 130 supplies, to the charging roller 2, a charge voltage Vcdc output from a DC power supply 131. The charge voltage Vcdc is divided by two resistance elements R3 and R4 to supply the voltage to the developing roller 2. To control the charge voltage Vcdc at a substantially constant level, the following voltage Vc and voltage Vref are input to an operational amplifier 132, and the output value of the operational amplifier 132 is fed back to the DC power supply 131. More specifically, one of the voltages is a preset control voltage Vc from a CPU 151 (FIG. 3) as a control IC of the image forming apparatus 100. The other one is a monitor voltage Vref obtained by reducing the charge voltage Vcdc at a ratio of R2/R1 and offsetting the voltage to a voltage of positive polarity based on a reference voltage Vrgv.

In the present embodiment, the common power supply 130 controls the charge voltage Vcdc at −1000 V and controls the development voltage Vdc at −350 V. In this case, the charging roller 2 charges the surface of the photosensitive drum 1 with a charge potential Vd at −500 V. Hereinafter, an area of the surface of the photosensitive drum 1 charged by the charging roller 2 will also be called a "charge area", and an area not charged will also be called a "non-charge area".

The toner housed in the developing apparatus 4 is charged to negative polarity (the toner is charged to the same polarity as in the charge area on the photosensitive drum 1).

Meanwhile, the primary transfer roller 5 is connected to the power supply for primary transfer 140 that can apply voltages of both positive and negative polarities. The power supply for primary transfer 140 includes a DC power supply of positive polarity (hereinafter, also called "positive power supply") 141, a DC power supply of negative polarity (hereinafter, also called "negative power supply") 142 and a current detection circuit 143. In the present embodiment, impedance of the primary transfer roller 5 and the intermediate transfer belt 71 is detected in preparation operation (pre-rotation) before the image forming operation. At the image forming operation, the positive power supply 141 is driven by constant voltage control to apply the primary transfer roller 5 with a primary transfer voltage reflecting the result. In the present embodiment, the CPU 151 (FIG. 3) detects the impedance based on a current value detected by the current detection circuit 143 when a predetermined voltage is applied to the primary transfer roller 5. A primary transfer voltage value at the image forming operation is determined according to the detection result.

As illustrated in FIG. 2, a charge section Nc is a position where the charging roller 2 executes the charge processing of the photosensitive drum 1 in the rotation direction (circumferential direction) of the photosensitive drum 1. In the present embodiment, the charging roller 2 charges the photosensitive drum 1 by electric discharge in a minute gap between the photosensitive drum 1 and the charging roller 2 on the upstream of a contact section (or closest section) between the photosensitive drum 1 and the charging roller 2 in the rotation direction of the photosensitive drum 1 and/or electric discharge in a similar minute gap on the downstream. However, to facilitate understanding of the present invention, the contact section (or closest section) between the photosensitive drum 1 and the charging roller 2 in the rotation direction of the photosensitive drum 1 is the charge section Nc here. When the photosensitive member is charged by an injection charging system, the charge processing is executed at a contact section between the photosensitive member and the charging member in the movement direction of the photosensitive member. As illustrated in FIG. 2, a developing portion Nd is a contact section between the photosensitive drum 1 and the developing roller 41 in the rotation direction of the photosensitive drum 1. As illustrated in FIG. 2, the primary transfer portion Nt is a contact section between the photosensitive drum 1 and the intermediate transfer belt 71 in the rotation direction of the photosensitive drum 1. As illustrated in FIG. 2, a cleaning section Nb is a contact section between the photosensitive drum 1 and the drum cleaning blade 61 in the rotation direction of the photosensitive drum 1.

3. Control Mode

Figure 3:
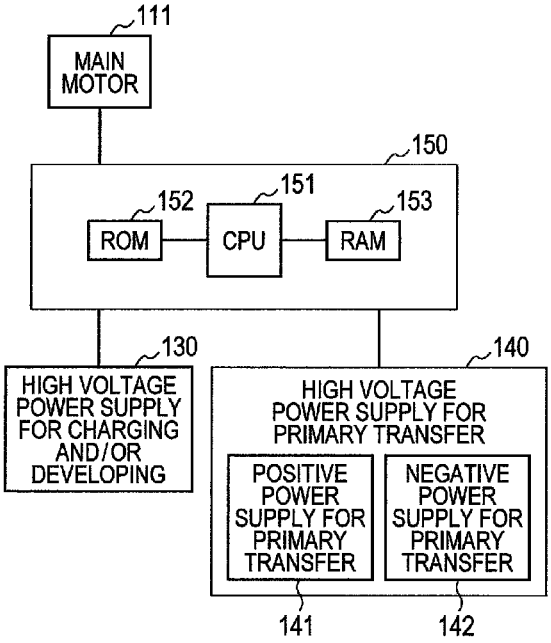
FIG. 3 is a block diagram illustrating a schematic control mode of main parts of the image forming apparatus according to the first embodiment.

FIG. 3 illustrates a schematic control mode of main parts of the image forming apparatus 100 according to the present embodiment. A control unit 150 arranged on the apparatus main body 110 of the image forming apparatus 100 includes: the CPU 151 as a control unit that is a main element for executing arithmetic processing; and a ROM 152 and a RAM 153 as storage units. The RAM 153 as a rewritable memory stores information input to the control unit 150, detected information and results of operation. The ROM 152 stores control programs and data tables obtained in advance. The CPU 151, the ROM 152 and the RAM 153 can mutually transfer and read the data.

The CPU 151 comprehensively controls the components of the image forming apparatus 100 to perform sequence operation according to the content of the control programs stored in the ROM 152. In relation to the present embodiment, the CPU 151 controls ON/OFF and output values of the DC power supply 131 of the common power supply 130. The CPU 151 also controls switching of output, ON/OF and output values of the positive power supply 141 and the negative power supply 142 of the power supply for primary transfer 140. The CPU 151 also controls ON/OFF of the main motor 111. The CPU 151 also controls to determine the primary transfer voltage at the image forming operation in the preparation operation. The control unit 150 can control the potential at the transfer portion Nt of the intermediate transfer belt 71. The content of the control will be described later.

An external host apparatus (not illustrated), such as an image reading apparatus and a personal computer, is connected to the apparatus main body 110 of the image forming apparatus 100, and the host apparatus inputs various information signals, such as image data, to the control unit 150 of the apparatus main body 110.

4. Movement of Toner at Initial Operation

Movement of the toner at the initial operation according to the present embodiment will be described. In the present embodiment, the initial operations in the image forming units SY, SM, SC and SK are substantially the same.

Figure 4:
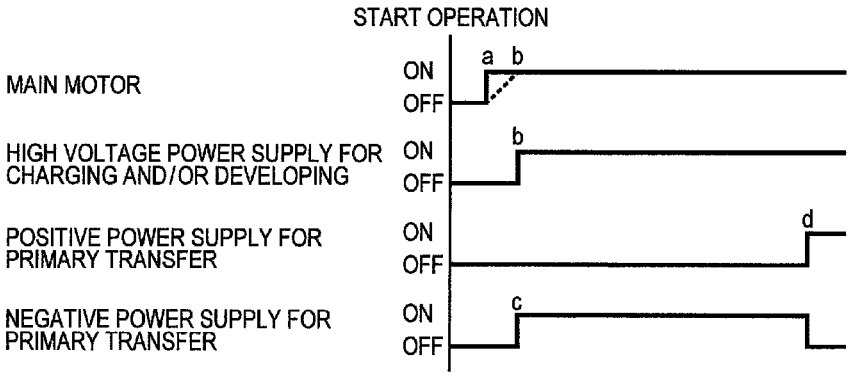
FIG. 4 is a timing chart diagram at the start of initial operation in the first embodiment.

FIG. 4 illustrates a timing chart at the start of initial operation by the main motor 111 as a driving source of the image forming apparatus 100, the common power supply 130, the positive power supply 141 and the negative power supply 142.

The "initial operation" denotes initial operation performed when the user switches the power supply of the image forming apparatus 100 from OFF to ON or initial operation performed after the control of the image forming apparatus 100 is reset due to a defect such as a paper jam (jam). Therefore, the initial operation is initial operation including rotation start operation of the photosensitive drum 1 executed after the input of power to the image forming apparatus 100, before the image can be formed. Various detection and preparation operations for image formation are performed in the initial operation, such as forming and detecting a control toner pattern (patch) on the photosensitive drum 1 for correcting the image density or color drift and detecting the potential of the photosensitive drum 1. In the present embodiment, at least charge processing of the photosensitive drum 1 at a predetermined potential is performed in the initial operation.

In FIG. 4, when the main motor 111 is turned on at a timing a after the start of the initial operation, the photosensitive drum 1 rotates in the arrow W1 direction in FIG. 2, and the intermediate transfer belt 71 moves in the arrow W2 direction in FIG. 2. In FIG. 4, a timing b denotes a timing of the launch of the main motor 111. In the present embodiment, the common power supply 130 is turned on at substantially the same timing as the timing b.

Figure 5A:
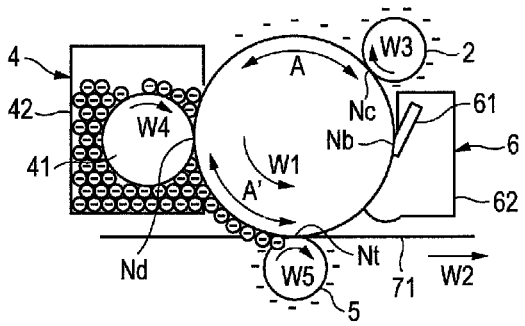
FIGS. 5A, 5B, 5C and 5D are schematic diagrams of the image forming unit for describing movement of toner at the start of the initial operation in the first embodiment.

FIG. 5A illustrates a state of the toner when the photosensitive drum 1 is rotated for a time period in which the surface of the photosensitive drum 1 moves in a section A' from the developing portion Nd to the primary transfer portion Nt after the common power supply 130 is turned on. A section A in FIG. 5A denotes a section on the photosensitive drum 1 that passes through the charge section Nc in a time period in which the surface of the photosensitive drum 1 moves in the section A' after the common power supply 130 is turned on. The distance (interval) of the section A and the distance of the section A' are the same in the rotation direction of the photosensitive drum 1.

In the present embodiment, the surface potential of the photosensitive drum 1 when the common power supply 130 is turned on is about 0 V. The charge voltage Vcdc is applied to the charging roller 2 in the section A after the common power supply 130 is turned on, and the surface of the photosensitive drum 1 is uniformly charged to negative polarity. Meanwhile, the surface of the photosensitive drum 1 is not charged in the section A', and the surface potential of the photosensitive drum 1 is about 0 V. Therefore, the toner on the developing roller 41 moves to the photosensitive drum 1 in the section A'. More specifically, the toner is electrostatically pulled toward the photosensitive drum 1 in the section A', and the entire surface of the photosensitive drum 1 in the section is developed. As described, unintended toner may be ultimately adhered to the recording material P if the toner is further transferred from the surface of the photosensitive drum 1 to the intermediate transfer belt 71, and a failure may occur.

On the other hand, in the present embodiment, the negative power supply 142 of the power supply for primary transfer 140 applies, to the primary transfer roller 5, a voltage (hereinafter also called "primary transfer negative voltage") of negative polarity that is the same polarity as the charged polarity of the toner at the time of development, during the same period, as illustrated in FIG. 5A.

In FIG. 4, a timing c in which the negative power supply 142 is turned on can be a timing in which the primary transfer negative voltage is surely launched after the common power supply 130 is turned on, before the toner moved to the photosensitive drum 1 reaches the primary transfer portion Nt. In the present embodiment, the timing c is substantially the same timing as the timing b. In the present embodiment, the primary transfer negative voltage applied to the primary transfer roller 5 at this time is controlled at −300 V.

At the primary transfer portion Nt, a voltage of negative polarity that is the same polarity as the charged polarity of the toner at the time of development is applied to the primary transfer roller 5, and the toner moved to the photosensitive drum 1 is electrostatically pulled toward the photosensitive drum 1. More specifically, an electric field that biases the toner, which is charged to the charged polarity (regular charged polarity) of the toner at the time of development, from the side of the intermediate transfer belt 71 to the side of the photosensitive drum 1 is formed at the primary transfer portion Nt, and the electric field acts on the toner moved to the photosensitive drum 1. This is because the potential of the intermediate transfer belt 71 can also be set to a potential of negative polarity by applying −300 V to the primary transfer roller 5. Therefore, the control unit 150 can control the potential of the intermediate transfer belt 71 at the transfer portion Nt to be a potential of the same polarity as the charged polarity of the toner at the time of development.

Figure 5B:
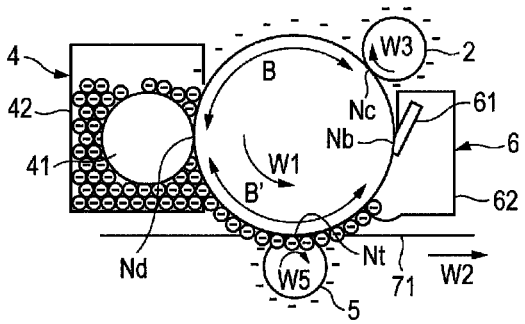

FIG. 5B illustrates a state of the toner when the charge area on the photosensitive drum 1 reaches the developing portion Nd after the common power supply 130 is turned on. A section B' in FIG. 5B denotes a section on the photosensitive drum 1 that passes through the developing portion Nd during the time period in which the surface of the photosensitive drum 1 moves in a section B from the charge section Nc to the developing portion Nd after the common power supply 130 is turned on. More specifically, the section B' denotes a section on the photosensitive drum 1 that passes through the developing portion Nd after the common power supply 130 is turned on, before the charge area on the photosensitive drum 1 reaches the developing portion Nd. The distance (interval) of the section B and the distance of the section B' in the rotation direction of the photosensitive drum 1 are the same.

As illustrated in FIG. 5B, a voltage of negative polarity that is the same polarity as the charged polarity of the toner at the time of development is applied to the primary transfer roller 5 at the primary transfer portion Nt. As a result, while being electrostatically pulled toward the photosensitive drum 1, the toner on the photosensitive drum 1 passes through the primary transfer portion Nt without being adhered to the intermediate transfer belt 71, and the toner is transmitted to the cleaning section Nb.

Figure 5C:
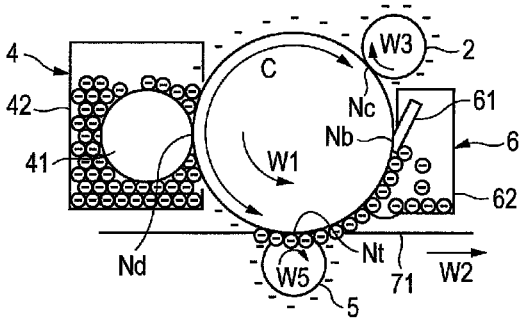

FIG. 5C illustrates a state of the toner when the charge area on the photosensitive drum 1 passes through the developing portion Nd and reaches in front of the primary transfer portion Nt after the common power supply 130 is turned on. A section C in FIG. 5C denotes a section in which the charge area on the photosensitive drum 1 moves before reaching in front of the primary transfer portion Nt, after the common power supply 130 is turned on. As illustrated in FIG. 5C, the charge area on the photosensitive drum 1 does not electrostatically pull the toner at the developing portion Nd. Meanwhile, at the cleaning section Nb, the drum cleaning blade 61 scrapes off the toner pulled to the photosensitive drum 1 earlier, and the toner is collected in the cleaning container 62.

Figure 5D:
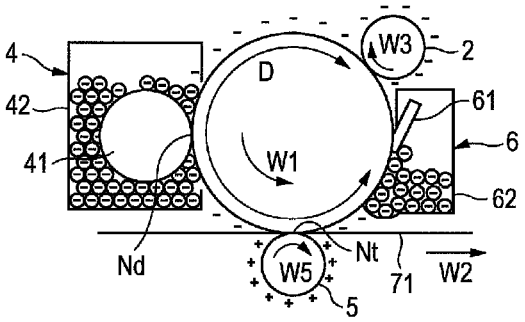

FIG. 5D illustrates a state of the toner when the charge area on the photosensitive drum 1 passes through the primary transfer portion Nt and reaches the cleaning section Nb, after the common power supply 130 is turned on. A section D in FIG. 5D denotes a section in which the charge area on the photosensitive drum 1 moves before reaching the cleaning section Nb, after the common power supply 130 is turned on. At this point, substantially all of the toner moved to the photosensitive drum 1 is collected in the cleaning container 62. At this point, the surface of the primary transfer roller 5 is charged to positive polarity. This is because at the image formation, the positive power supply 141 of the power supply for primary transfer 140 applies a voltage (hereinafter, also called "primary transfer positive voltage") of positive polarity that is opposite the charged polarity of the toner at the time of development in order to pull the toner toward the intermediate transfer belt 71.

In FIG. 4, a timing d of switching the power supply, that is, turning on the positive power supply 141 after turning off the negative power supply 142 is after a timing in which substantially all of the toner moved to the photosensitive drum 1 passes through the primary transfer portion Nt. In the present embodiment, the timing d is just after substantially all of the toner moved to the photosensitive drum 1 has passed through the primary transfer portion Nt. Therefore, the negative power supply 142 is turned on at least after the common power supply 130 is turned on, before the charge area on the photosensitive drum 1 reaches the primary transfer portion Nt. Typically, the negative power supply 140 is then turned off, and the positive power supply 141 is turned on. The timing of switching the polarity of voltage applied to the primary transfer roller 5 from negative polarity to positive polarity is not limited to the ones described in the present embodiment, and the polarity may be switched after a predetermined time after substantially all of the toner moved to the photosensitive drum 1 passes through the primary transfer portion Nt.

In this way, the image forming apparatus 100 of the present embodiment includes: the rotatable photosensitive member 1; the charging device 2 that charges the photosensitive member 1; and the exposure device 3 that exposes the charged photosensitive member 1 to form an electrostatic image on the photosensitive member. The image forming apparatus 100 further includes: the developing unit 4 that supplies the toner to the photosensitive member 1 at the developing portion Nd to develop a toner image from the electrostatic image on the photosensitive member; and the common power supply 130 that applies voltage to the charging device 2 and the developing unit 4. The image forming apparatus 100 further includes: the movable rotary member 71 that forms the transfer portion Nt with the photosensitive member 1 and that receives the toner image from the photosensitive member 1; and the control unit 150 that controls the potential at the transfer portion Nt of the rotary member 71. In the present embodiment, at the start of the rotation of the photosensitive member 1, the control unit 150 performs the following control after the start of the output by the common power supply 130, before the charge area on the photosensitive member reaches the transfer portion Nt. More specifically, the control unit 150 controls the potential at the transfer portion Nt of the rotary member 71 to be a potential of the same polarity as the charged polarity of the toner at the time of development.

Particularly, the image forming apparatus 100 of the present embodiment includes the transfer device 5 that is arranged corresponding to the photosensitive member 1 and that receives voltage from the transfer power supply 140 to transfer the toner image on the photosensitive member to the rotary member 71 at the transfer portion Nt. In the present embodiment, the control unit 150 causes the transfer power supply 140 to apply, to the transfer device 5, voltage of the same polarity as the charged polarity of the toner at the time of development so that the potential at the transfer portion Nt of the rotary member 71 becomes a potential of the same polarity as the charged polarity of the toner at the time of development. Alternatively, instead of arranging the transfer device 5 at the position facing the photosensitive member 1, a charging device of the rotary member 71 may charge the rotary member 71 to a predetermined potential to transfer the toner image from the photosensitive member 1 to the rotary member 71. In this case, at the start of the rotation of the photosensitive member 1, the control unit 150 can cause the charging device of the rotary member 71 to control the potential of the rotary member 71 at the transfer portion Nt to be a potential of the same polarity as the charged polarity of the toner at the time of development.

At the start of the rotation of the photosensitive member 1, the application of the voltage of the same polarity can be started after the start of the output by the common power supply 130, before the section on the photosensitive member at the developing portion Nd at the start of the output reaches the transfer portion Nt. The application of the voltage of the same polarity can be stopped after the charge area on the photosensitive member reaches the transfer portion Nt. Particularly, at the start of the rotation of the photosensitive member 1 in the present embodiment, the application of the voltage of the same polarity is started at substantially the same time as the start of the output by the common power supply 130, and the application of the voltage of the same polarity is stopped just after the charge area on the photosensitive member passes through the transfer portion Nt.

In the present embodiment, the series of operation (FIG. 4) is similarly performed in the first, second, third and fourth image forming units SY, SM, SC and SK. This can prevent the transfer of the toner of each color to the intermediate transfer belt 71 at the start of the initial operation.

As described, in the image forming apparatus 100 of the present embodiment, the common power supply applies voltage to the charging device and the developing unit. In this configuration of the present embodiment, a voltage of the same polarity as the charged polarity of the toner at the time of development is applied to the primary transfer roller 5 after the start of the output by the common power supply 130, at least before the charge area on the photosensitive drum 1 reaches the primary transfer portion Nt. As a result, the toner on the photosensitive drum 1 can be collected in the photosensitive drum 1, without transferring the toner to the intermediate transfer belt 71. This can prevent staining the intermediate transfer belt 71 by the toner, and an excellent image can be provided.

Second Embodiment

Another embodiment of the present invention will be described. A basic configuration and operation of an image forming apparatus of the present embodiment are the same as those in the first embodiment. Therefore, the same or equivalent elements to those of the image forming apparatus of the first embodiment are designated with the same reference numerals in the image forming apparatus of the present embodiment, and the detailed description will be omitted.

1. Configuration of Image Forming Apparatus of the Present Embodiment

Figure 6A:
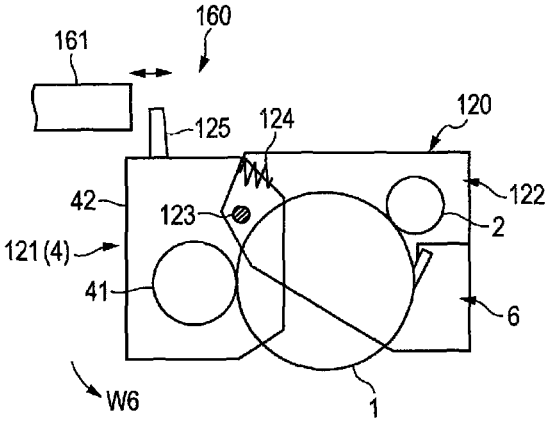
FIGS. 6A and 6B are schematic diagrams of the surrounding of a process cartridge for describing states of a contact and separation unit and a process cartridge in an image forming apparatus according to a second embodiment.
Figure 6B:
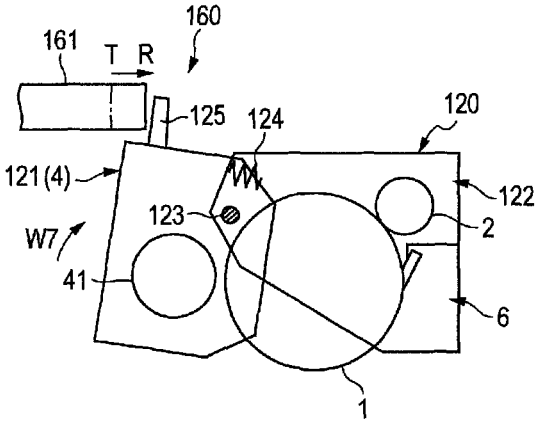
Figure 7:
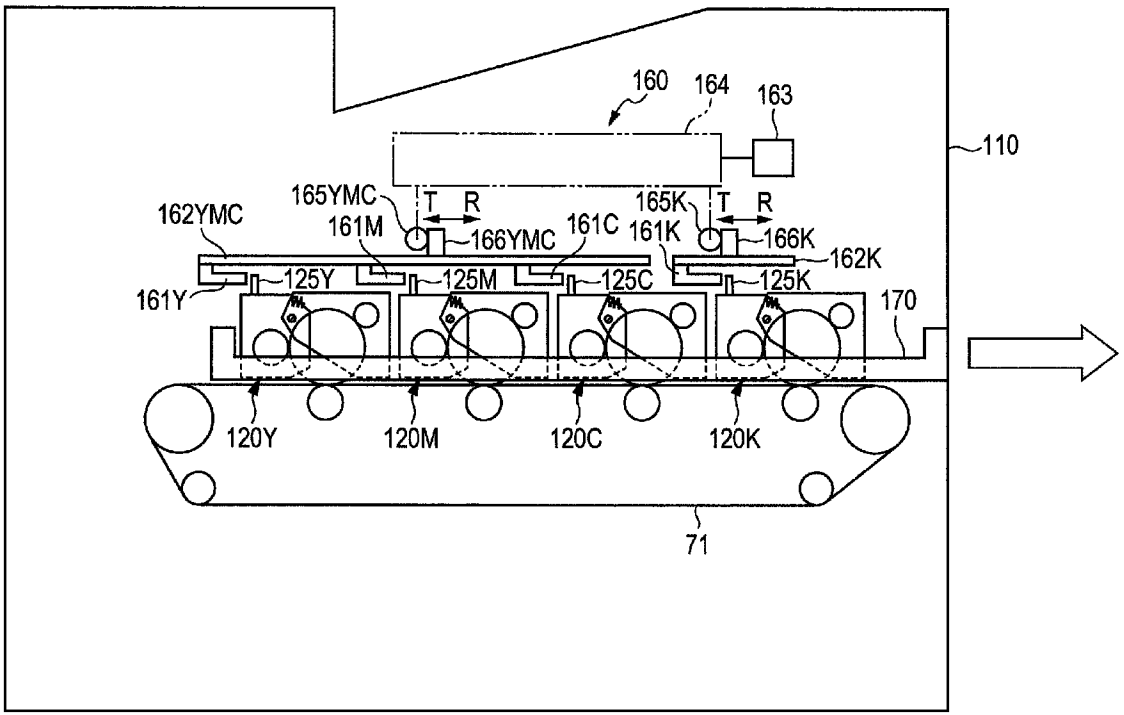
FIG. 7 is a schematic cross-sectional view of main parts of the image forming apparatus for describing a take-out state of a cartridge tray in the image forming apparatus according to the second embodiment.

As illustrated in FIGS. 6A, 6B and 7, the image forming apparatus 100 of the present embodiment includes a contact and separation unit 160 as a contact and separation device that can cause the developing roller 41 to be in contact with or separated from the photosensitive drum 1.

In the following description, the contact of the developing roller 41 to the photosensitive drum 1 will also be called "development contact". The separation of the developing roller 41 from the photosensitive drum 1 will also be called "development separation".

FIG. 6A illustrates states of the contact and separation unit 160 and the process cartridge 120 at the development contact. The process cartridge 120 is divided into: a developing unit 121 (i.e. the developing apparatus 4) that supports the developing roller 41 and that is provided with the development container 42; and a cleaning unit 122 in which the photosensitive drum 1, the charging roller 2 and the drum cleaner 6 are integrated by a frame body. The developing unit 121 and the cleaning unit 122 are connected so as to be able to turn (swing) about a fulcrum 123. A pressure spring 124 as a biasing unit that biases the developing unit 121 to turn in an arrow W6 direction in FIG. 6A is arranged between the developing unit 121 and the cleaning unit 122. As a result, the developing unit 121 is biased toward the cleaning unit 122 so that the developing roller 41 comes in contact with the photosensitive drum 1 at a predetermined pressure. A separation claw 125 as an effect reception unit that receives an effect of the contact and separation unit 160 is fixed and attached to the outer surface (in the present embodiment, above) of the developing unit 121. A cam 161 as an effect section of the contact and separation unit 160 is arranged in the apparatus main body 110 of the image forming apparatus 100.

FIG. 7 illustrates a relationship between the cam 161 and the process cartridge 120 in each image forming unit S. As illustrated in FIG. 7, cams 161Y, 161M, 161C and 161K are arranged for the separation claws 125 of the process cartridges 120 of all image forming units S in the present embodiment. A solenoid 163 as a driving source of the contact and separation unit 160 drives the cams 161Y, 161M, 161C and 161M, and the cams 161Y, 161M, 161C and 161M can slide in a horizontal direction (T-R direction) in FIG. 7.

In the present embodiment, the image forming apparatus 100 can execute the image forming operation in a full-color image formation mode and a black image formation mode. This is to increase the lifetime of various elements of the color (yellow, magenta and cyan) image forming units SY, SM and SC. In the full-color image formation mode, all image forming units SY, SM, SC and SK are in the development contact state. In the black image formation mode, only the black image forming unit SK is in the development contact state. Therefore, in the present embodiment, the cams 161Y, 161M and 161C for the color image forming units SY, SM and SC and the cam 161K for the black image forming unit SK can be separately driven as illustrated in FIG. 7. In the present embodiment, the cams 161Y, 161M and 161C for the color image forming units SY, SM and SC are fixed to a same cam driving unit for colors 162YMC, and the cam driving unit for colors 162YMC can transmit the drive of the solenoid 163 to move the cams 161Y, 161M and 161C in an integrated manner. The cam 161K for the black image forming unit SK is fixed to a cam driving unit for black 162K independently from the cam driving unit for colors 162YMC, and the cam driving unit for black 162K can transmit the drive of the solenoid 163 to independently move the cam 161K. In this way, the case of setting the development contact state only in the black image forming unit SK and the case of setting the development contact state in all image forming units SY, SM, SC and SK are divided according to the image formation mode.

Furthermore, for example, the contact and separation unit 160 includes: a switching cam for colors 165YMC engaged with a drive reception unit 166YMC of the cam driving unit for colors 162YMC; and a switching cam for black 165K engaged with a drive reception unit 166K of the cam driving unit for black 162K. The contact and separation unit 160 also includes a drive transmission unit 164 that transmits the driving force from the solenoid 163 to the switching cams 165YMC and 165K. The drive transmission unit 164 includes, for example, gears and a rotation axis to interlock and rotate the switching cam for colors 165YMC and the switching cam for black 165K in the same direction. The drive transmission unit 164 operates the solenoid 163 for a predetermined amount (predetermined times) to move the cam driving unit for colors 162YMC and the cam driving unit for black 162K according to the cam profiles of the switching cam for colors 165YMC and the switching cam for black 165K. In this way, the status between development contact and separation is switched in the full-color image formation mode and the black image formation mode.

The apparatus main body 110 of the image forming apparatus 100 includes, as a mounting unit of the process cartridge 120, a cartridge tray 170 that houses the process cartridges 120Y, 120M, 120C and 120K in parallel. The cartridge tray 170 allows integrally taking the process cartridges 120Y, 120M, 120C and 120K in and out of the apparatus main body 110 in a slide format, in the horizontal direction of FIG. 7.

FIG. 6B illustrates states of the contact and separation unit 160 and the process cartridge 120 in the development separation. As illustrated in FIG. 6B, the cam 161 arranged on the apparatus main body 110 moves from a T position (left side in FIG. 6B) to an R position (right side in FIG. 6B) to push the separation claw 125 attached to the developing unit 121 from the left side to the right side (T→R direction) in FIG. 6B. Consequently, the developing unit 121 rotates about the fulcrum 123 in an arrow W7 direction in FIG. 6B, and the developing roller 41 separates from the photosensitive drum 1.

2. Outline of Control

Figure 8:
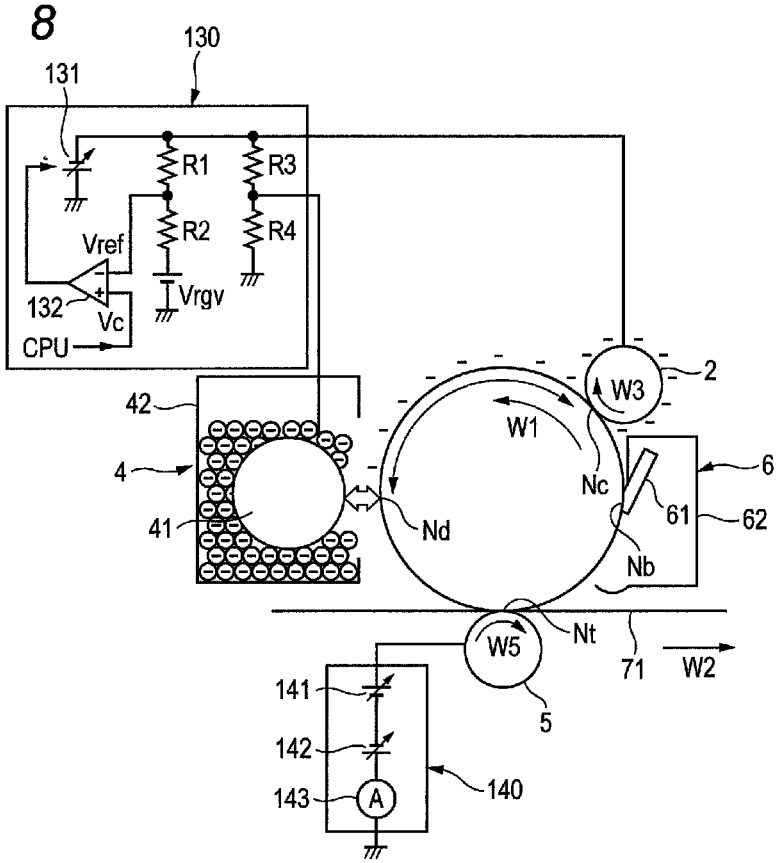
FIG. 8 is a schematic diagram of the image forming unit illustrating an example of operation at the start of the initial operation in the second embodiment.

When the contact and separation unit 160 is arranged, the developing roller 41 is generally separated from the photosensitive drum 1 (development separation state) at times other than when the image is formed. This is to prevent toner fogging in which the toner is adhered to the photosensitive drum 1 due to rubbing between the developing roller 41 and the photosensitive drum 1 or to prevent abrasion of the photosensitive drum 1 due to rubbing (increase the lifetime). Therefore, the development separation state is generally set at the start of the initial operation. As a result, if the development separation state is actually set at the start of the initial operation, the following initial operation (hereinafter, also called "initial operation when the developing roller separates from the photosensitive drum") can be performed. More specifically, at the start of the initial operation, the common power supply 130 is turned on while the developing roller 41 is separated from the photosensitive drum 1 (development separation state). When the charge area on the photosensitive drum 1 reaches a position that allows contacting the developing roller 41 (position corresponding to the developing portion Nd), the developing roller 41 is brought into contact with the photosensitive drum. In this way, the surface of the photosensitive drum 1 is uniformly charged to negative polarity when the developing roller 41 comes into contact with the photosensitive drum 1 as illustrated in FIG. 8. Therefore, the toner does not move to the photosensitive drum 1 as described in the first embodiment.

However, the development contact state may be set at the start of the initial operation in the image forming apparatus 100 of the present embodiment. This applies not only to the image forming apparatus 100 of the present embodiment, but also to image forming apparatuses in general that include the contact and separation units.

Figure 9:
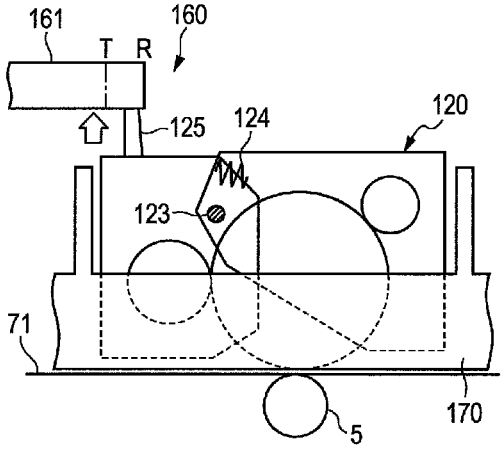
FIG. 9 is a schematic diagram of the surrounding of the process cartridge illustrating an example of states of the process cartridge and the cartridge tray in the image forming apparatus according to the second embodiment.

For example, when the user takes out the cartridge tray 170 (FIG. 7), the development contact state is set in the image forming apparatus 100 of the present embodiment. More specifically, when the user takes out the cartridge tray 170 in the present embodiment, a pop-up mechanism (not illustrated) moves the cartridge tray 170 housing the process cartridge 120 upward in FIG. 7 so that the cartridge tray 170 separates from the intermediate transfer belt 71. This is to prevent rubbing between the photosensitive drum 1 and the intermediate transfer belt 71 when the user takes out the cartridge tray 170. In this case, the cam 161 moves upward in synchronization with the cartridge tray 170, while the position in the horizontal direction (T-R direction) in FIG. 7 is fixed. As the cartridge tray 170 is taken out from the apparatus main body 110 toward the right side (direction from T to R) in FIG. 7, the separation claw 125 departs from the cam 161, and the process cartridge 120 enters the development contact state. In this state, when the cartridge tray 170 is inserted again to the left side (direction from R to T) in FIG. 7 and installed in the apparatus main body 110, the separation claw 125 pushes up the cam 161 upward as illustrated in FIG. 9. In this case, the initial operation is started in the development contact state. The initial operation is similarly started in the development contact state when the process cartridge 120 is replaced by a new one.

The image forming apparatus 100 of the present embodiment includes a record storage unit 180 formed by a storage unit that can store a record of taking in or out the cartridge tray 170. Therefore, the record of taking in or out the cartridge tray 170 is stored if the power supply plug of the image forming apparatus 100 is inserted to the socket (if power necessary to store the record is supplied). As a result, whether the cartridge tray 170 is taken in or out can be determined from the information of the record storage unit 180 if the power supply plug of the image forming apparatus 100 is inserted to the socket. If the CPU 151 determines that the cartridge tray 170 is taken in or out, the CPU 151 can start the initial operation by determining that the development contact state is set.

However, if the power supply plug of the image forming apparatus 100 is pulled out from the socket, the record of taking in or out the cartridge tray 170 cannot be stored in the record storage unit 180 in this state. Therefore, after the power supply plug of the image forming apparatus 100 is pulled out from the socket, whether the cartridge tray 170 is taken in or out cannot be determined when the power supply plug is pulled out. Therefore, the status between development contact and separation at the start of the initial operation cannot be accurately determined after the power supply plug of the image forming apparatus 100 is pulled out from the socket.

For example, it is assumed that the power supply plug of the image forming apparatus 100 is pulled out from the socket in the development separation state (the cam 161 is at the R position) and that the cartridge tray 170 is taken in or out. In this case, although the development contact state is supposed to be actually set, the state of the cam 161 is still R. Since the cartridge tray 170 is taken in or out when the power supply plug is pulled out from the socket, the record of taking in or out the cartridge tray 170 is not stored in the record storage unit 180. Therefore, if the determination is made only from the state of the cam 161, the development separation state is falsely detected at the start of the next initial operation.

Similarly, the positions of the cam 161 and the separation claw 125 are mismatched (FIG. 9) in a sudden failure, such as a jam and blackout. The status between development contact and separation at the start of the next initial operation cannot be accurately determined in some cases.

In the present embodiment, if there is a possibility that the status between development contact and separation at the start of the initial operation cannot be accurately determined, initial operation (hereinafter, also called "initial operation when the developing roller contacts the photosensitive drum") is started as in the first embodiment by assuming that the state is the development contact state. More specifically, at the start of the initial operation, a voltage of negative polarity is applied to the primary transfer roller 5 to pull the toner toward the photosensitive drum 1. The toner passes through without being adhered to the intermediate transfer belt 71, and the toner is collected in the cleaning container 62.

Subsequently, for example, the solenoid 163 can be repeatedly driven to move the cam 161 for a plurality of times between the T position and the R position, and the development separation state, which is the home position of the process cartridge 120, can be set to prepare for the following image formation. The reason that the operation is not performed before the start of the initial operation is to reduce the time period between the power activation of the image forming apparatus 100 to the output of the first image as much as possible, for example. Even if the position of the cam 161 and the actual status between development contact and separation are mismatched at the start of the initial operation as described above, the initial operation can be usually performed without a problem. However, in the configuration of applying the charge voltage and the development voltage from the common power supply as described above, the toner moved to the non-charge area on the photosensitive drum 1 is transferred to the intermediate transfer belt 71 if the initial operation is started in the development contact state. Therefore, the control of the present embodiment is significantly effective in reducing the time before the output of the first image as much possible and in preventing the transfer of the toner of the non-charge area on the photosensitive drum 1 to the intermediate transfer belt 71.

3. Control Mode and Control Flow

A control mode and a control flow of the image forming apparatus 100 according to the present embodiment for realizing the control will be described.

Figure 10:
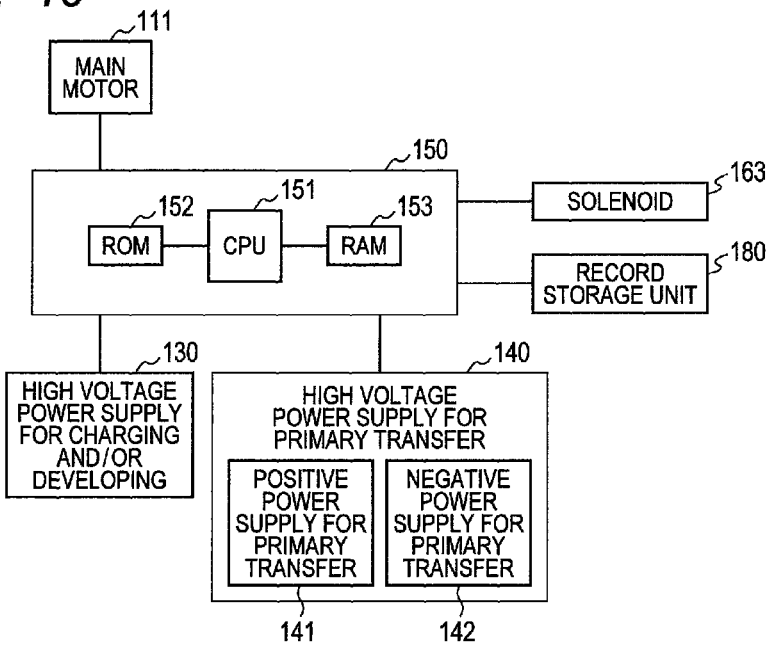
FIG. 10 is a block diagram illustrating a schematic control mode of main parts of the image forming apparatus according to the second embodiment.

FIG. 10 illustrates a schematic control mode of main parts of the image forming apparatus 100 of the present embodiment. The schematic control mode of main parts of the image forming apparatus 100 of the present embodiment is similar to that of the first embodiment illustrated in FIG. 3. In the present embodiment, the image forming apparatus 100 further includes: the solenoid 163 of the contact and separation unit 160; and the record storage unit 180 that stores a record of taking in or out the cartridge tray 170.

Figure 11:
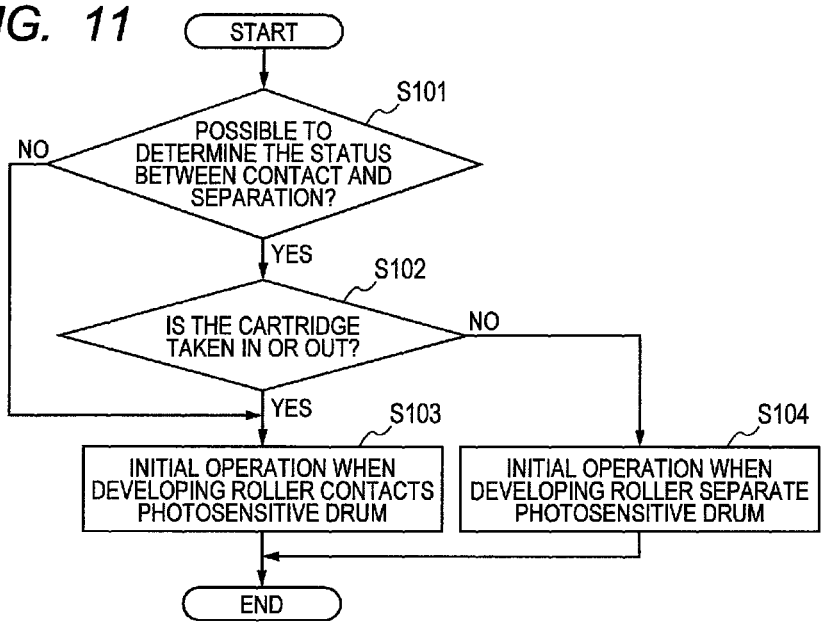
FIG. 11 is a flow diagram illustrating a schematic control procedure of the initial operation in the second embodiment.

FIG. 11 illustrates a schematic control flow of the control of the initial operation according to the present embodiment.

S101: The CPU 151 determines whether the status between development contact and separation can be accurately determined at the start of the initial operation. If the CPU 151 determines that the status between development contact and separation can be accurately determined (Yes), the CPU 151 proceeds to S102. Otherwise (No), the CPU 151 proceeds to S103. In this case, the CPU 151 determines that the state is the "development contact state".

S102: The CPU 151 determines whether the cartridge tray 170 is taken in or out based on the information of the record storage unit 180. If the CPU 151 determines that the cartridge tray 170 is taken in or out (Yes), the CPU 151 proceeds to S103. In this case, the CPU 151 can determine that the state is the "development contact state". On the other hand, if the CPU 151 determines that the cartridge tray 170 is not taken in or out (No), the CPU 151 proceeds to S104. In this case, the CPU 151 can determine that the state is the "development separation state".

S103: The CPU 151 executes initial operation when the developing roller contacts the photosensitive drum. Subsequently, the CPU 151 ends the process.

S104: The CPU 151 performs initial operation when the developing roller separates from the photosensitive drum. Subsequently, the CPU 151 ends the process.

The CPU 151 can determine that the power supply plug is inserted to the socket (or that the main power supply switch that cuts off the entire power supply is turned on). The CPU 151 can also determine that the power supply is turned on after the entire power supply is cut off by a jam or blackout. In these cases, the CPU 151 can determine in S101 that the status between development contact and separation cannot be accurately determined. In other cases, the CPU 151 can determine that the status between development contact and separation can be accurately determined.

In this way, the image forming apparatus 100 of the present embodiment includes the movement unit (contact and separation unit) 160 that moves the relative position of the developing unit 4 and the photosensitive member 1 to a first position and to a second position in which the developing unit 4 is further away from the photosensitive member 1 than at the first position. The image forming apparatus 100 also includes the determination unit (CPU) 151 that determines whether the relative position between the developing unit 4 and the photosensitive position 1 at the start of the rotation of the photosensitive member 1 is the first position or the second position. In the present embodiment, if the determination unit 151 determines that the relative position between the developing unit 4 and the photosensitive member 1 at the start of the rotation of the photosensitive member 1 is the first position, the voltage of the same polarity as the toner is applied to the transfer device 5 at the start of the ration of the photosensitive member 1. On the other hand, if the determination unit 151 determines that the relative position between the developing unit 4 and the photosensitive member 1 at the start of the rotation of the photosensitive member 1 is the second position, the following is performed in the present embodiment. In this case, at the start of the rotation of the photosensitive member 1, the relative position between the developing unit and the photosensitive member 1 is maintained at the second position until the charge area on the photosensitive member reaches the developing portion Nd. In the present embodiment, the determination unit 151 determines that the relative position between the developing unit 4 and the photosensitive member 1 is the first position if the relative position between the developing unit 4 and the photosensitive member 1 is actually the first position or if the relative position can be the first position at the start of the rotation of the photosensitive member 1.

Therefore, whether to perform the initial operation when the developing roller contacts the photosensitive drum or to perform the initial operation when the developing roller separates from the photosensitive drum is changed according to the status between development contact and separation in the present embodiment. This can more surely prevent the transfer of the toner to the intermediate transfer belt 71 at the initial operation.

As described, the image forming apparatus in the present embodiment includes the contact and separation unit 160 that can cause the developing roller 41 to be in contact with or separated from the photosensitive drum 1. According to the configuration, the status between development contact and separation at the start of the initial operation may not be accurately determined. Therefore, if the state is determined to be or estimated to be the development contact state in the present embodiment, the initial operation is started as in the first embodiment. More specifically, a voltage of the same polarity as the charged polarity of the toner at the time of development is applied to the primary transfer roller 5 after the start of the output by the common power supply 130, at least before the charge area on the photosensitive drum 1 reaches the primary transfer portion Nt. As a result, the toner on the photosensitive drum 1 can be collected in the photosensitive drum 1, without transferring the toner to the intermediate transfer belt 71. This can prevent staining the intermediate transfer belt 71 by the toner, and an excellent image can be provided.

Third Embodiment

Another embodiment of the present invention will be described. A basic configuration and operation of an image forming apparatus of the present embodiment are the same as those of the first and second embodiments. Therefore, the same or equivalent elements to those of the image forming apparatuses of the first and second embodiments are designated with the same reference numerals in the image forming apparatus of the present embodiment, and the detailed description will be omitted. The image forming apparatus 100 of the present embodiment particularly includes the contact and separation unit 160 as in the second embodiment.

1. Configuration of Image Forming Apparatus of the Present Embodiment

The image forming apparatus 100 of the present embodiment cleans the intermediate transfer belt 71 based on an electrostatic cleaning system. The electrostatic cleaning system denotes a system of cleaning the intermediate transfer belt 71 by charging the toner on the intermediate transfer belt 71 by the polarity opposite the charged polarity of the toner at the time of development to move (reversely transfer) the toner to the photosensitive drum 1 at the primary transfer portion Nt.

Figure 12:
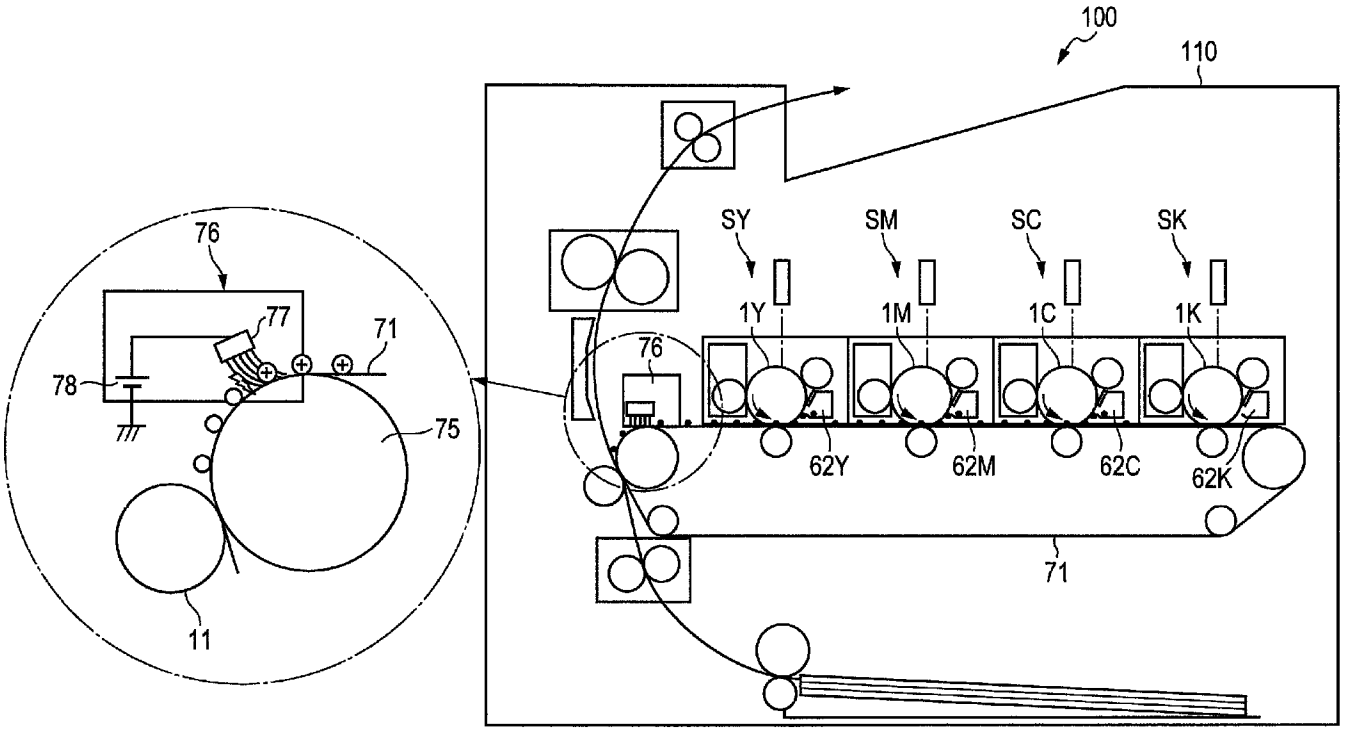
FIG. 12 is a schematic cross-sectional view of main parts of an image forming apparatus according to a third embodiment.

FIG. 12 illustrates a schematic configuration of elements related to the cleaning of the intermediate transfer belt 71 based on the electrostatic cleaning system according to the present embodiment. In the image forming apparatus 100 of the present embodiment, the belt cleaner as an intermediate transfer member cleaning unit includes a conductive brush (brush with conductivity) 77 as a charging device that is a brush-like charging member including conductive fibers. The conductive brush 77 is in contact with the intermediate transfer belt 71 at a predetermined pressure. In the present embodiment, the conductive brush 77 is in contact with the intermediate transfer belt 71 on the downstream of the secondary transfer portion Ns and on the upstream of the primary transfer portion NtY of the uppermost yellow image forming unit SY in the movement direction of the intermediate transfer belt 71. A cleaning high voltage power supply 78 as a cleaning voltage applying unit applies, to the conductive brush 77, a cleaning voltage of positive polarity that is opposite the charged polarity of the toner at the time of development, and the toner on the intermediate transfer belt 71 is charged to positive polarity. The toner charged to positive polarity by the conductive brush 77 is electrostatically pulled to the photosensitive drum 1 (1Y, 1M, 1C or 1K) at the primary transfer portion Nt and collected in the cleaning container 62 (62Y, 62M, 62C or 62K). In this case, the primary transfer voltage of positive polarity that is opposite the charged polarity of the toner at the time of development can be applied to the primary transfer roller 5 (5Y, 5M, 5C or 5K).

Figure 13:
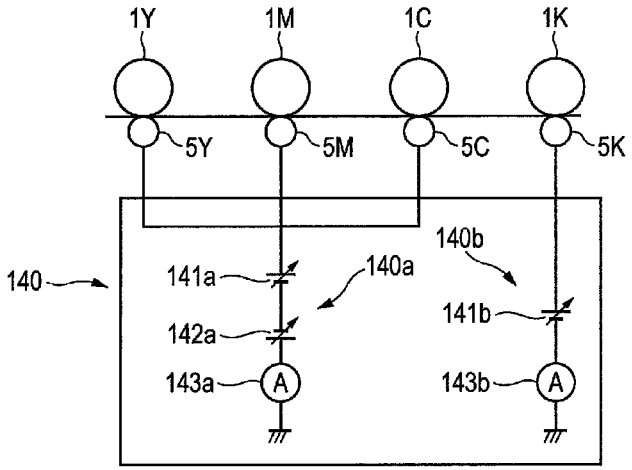
FIG. 13 is a schematic diagram illustrating a schematic configuration of a high voltage power supply for primary transfer in the image forming apparatus according to the third embodiment.

In the image forming apparatus 100 of the present embodiment, a power supply for primary transfer 140*b* of the black image forming unit SK can apply only a voltage of positive polarity to the primary transfer roller 5 and cannot apply a voltage of negative polarity as illustrated in FIG. 13. In the image forming apparatus 100 of the present embodiment, a common power supply for primary transfer 140*a* can apply voltages of positive and negative polarities to the primary transfer rollers SY, SM and SC of the color image forming units SY, SM and SC.

More specifically, in the present embodiment, the common power supply for primary transfer 140*a* of the color image forming units SY, SM and SC includes a positive power supply 141*a*, a negative power supply 142*a* and a current detection circuit 143*a*. Based on the configuration, the impedance of the primary transfer rollers 5Y, 5M, 5C and the intermediate transfer belt 71 is detected in the preparation operation (pre-rotation) before the image forming operation. At the image forming operation, the positive power supply 141*a* is driven by constant voltage control to apply a primary transfer voltage reflecting the result to the primary transfer rollers 5Y, 5M and 5C. Meanwhile, the power supply for primary transfer 140*b* of the black image forming unit SK includes a positive power supply 141*b* and a current detection circuit 143*b*. Based on the configuration, the impedance of the primary transfer roller 5K and the intermediate transfer belt 71 is detected in the preparation operation (pre-rotation) before the image forming operation. At the image forming operation, the positive power supply 141*b* is driven by constant voltage control to apply a primary transfer voltage reflecting the result to the primary transfer roller 5K. In this way, the positive power supply 141*b* applies the independently controlled primary transfer voltage to the primary transfer roller 5K in the black image forming unit SK.

At the moment of the start of the initial operation, the image forming apparatus 100 of the present embodiment cannot determine the status between development contact and separation at the start of the initial operation. However, the image forming apparatus 100 can determine the status during the initial operation. A specific determination method will be described with reference to Table 1.

In the image forming apparatus 100 of the present embodiment, a sensor 190 (FIG. 16) as a detection unit that detects the cam position is turned on and off based on the positions of the cam driving unit for colors 162YMC and the cam driving unit for black 162K. Examples of the sensor 190 include a photo-interrupter and a micro switch for detecting the detection sections (flags) arranged on the drive transmission unit 164 and the cam driving units 162YMC and 162K (FIG. 7).

TABLE 1

| Cam Position | Cam for Color | Cam for Black | Sensor | Actual Status between Development Contact and Separation at Start of Initial Operation |
|---|---|---|---|---|
| (1) Complete Separation (Home) | R | R | OFF | Unknown |
| (2) Complete Contact | T | T | ON | Complete Contact |
| (3) "K Contact" | R | T | OFF | Unknown |

Table 1 illustrates positions of the cam driving unit for colors 162YMC and the cam driving unit for black 162K, ON/OFF of the sensor 190 at the positions and states of the cam positions. In the present embodiment, the following three cam positions of "complete separation", "complete contact" and "K contact" are set. The statuses between development contact and separation corresponding to these three cam positions in normal operation will also be called "complete separation state", "complete contact state" and "K contact state".

(1) In the "complete separation", the cam driving unit for colors 162YMC and the cam driving unit for black 162K are at the R position, and the sensor 190 is turned off in this case. The cam position in this case will also be called a "home position".

(2) In the "complete contact", the cam driving unit for colors 162YMC and the cam driving unit for black 162K are at the T position, and the sensor 190 is turned on in this case.

(3) In the "K contact", the cam for colors 162YMC is at the R position, and the cam driving unit for black 162K is at the T position. The sensor 190 is turned off in this case.

Therefore, the sensor 190 is turned on only when the cam driving unit for colors 162YMC and the cam driving unit for black 162K are at the T position, and the sensor 190 is turned off in other cases. In the present embodiment, the solenoid 163 (FIG. 16) sequentially switches the cam position in the order of (1)→(2)→(3)→(1)→(2)→(3)→ . . . . Therefore, the "complete separation" is the "home position" of the cam position as described above. In the full-color image formation mode, the solenoid 163 is taken once from the "home position" ((1)→(2)) to set the cam position to the "complete contact", and then the image forming operation is performed. In the black image formation mode, the solenoid 163 is taken twice from the "home position" ((1)→(2)→(3)) to set the cam position to the "K contact", and then the image forming operation is performed.

Based on the configuration, the cam position can only be (2) the "complete contact" when the sensor 190 is turned on at the start of the initial operation. Therefore, the actual status between development contact and separation can be surely determined as the "complete contact state" when the sensor 190 is turned on at the start of the initial operation.

On the other hand, whether the cam position is (1) the "complete separation" or (3) the "K contact" cannot be determined when the sensor 190 is turned off at the start of the initial operation. However, although the cam position cannot be determined at the moment of the start of the initial operation, the cam position at the start of the initial operation can be determined when the sensor 190 is turned on by taking the solenoid 163 once or twice after the start of the initial operation. Therefore, if the sensor 190 is turned on when the solenoid 163 is taken once, the cam position can be determined to be (1) the "complete separation" at the start of the initial operation. If the sensor 190 is turned on when the solenoid 163 is taken twice, the cam position can be determined to be (3) the "K contact" at the start of the initial operation.

However, even if whether the cam position at the start of the initial operation is (1) the "complete operation" or (3) the "K contact" can be determined from the number of times the solenoid 163 is taken, the actual status between development contact and separation cannot be accurately determined in some cases as described in the second embodiment. As described in the second embodiment, those cases include when the power supply plug of the image forming apparatus 100 is pulled out from the socket before the start of the initial operation and when there is a sudden failure, such as a jam and blackout. In that case, the actual status between development contact and separation at the start of the initial operation cannot be accurately determined.

For example, it is assumed that the user has pulled out the power supply plug of the image forming apparatus 100 from the socket in the state of (3) the "K contact" and taken in or out the cartridge tray 170. In this case, the status between development contact and separation would be the "complete contact state". However, the sensor 190 is switched from OFF to ON when the solenoid 163 is taken twice in the next initial operation, and the status is determined to be (3) the "K contact" at the start of the initial operation. The same applies to (1) the "complete separation".

Therefore, the status between development contact and separation is always assumed to be the "complete contact state" in the present embodiment when the power supply plug of the image forming apparatus 100 is pulled out from the socket or when a failure occurs in the image forming apparatus 100, such as a jam and blackout.

2. Outline of Control

In the present embodiment, the image forming apparatus 100 with the feature described above controls the initial operation as follows.

In the present embodiment, the color image forming units SY, SM and SC start the initial operation when the developing roller contacts the photosensitive drum as in the first embodiment, regardless of the ON/OFF state of the sensor 190 at the start of the initial operation. More specifically, at the start of the initial operation, a voltage of negative polarity is applied to the primary transfer roller 5 to pull the toner toward the photosensitive drum 1. The toner passes through without being adhered to the intermediate transfer belt 71, and the toner is collected in the cleaning container 62.

Figure 14:
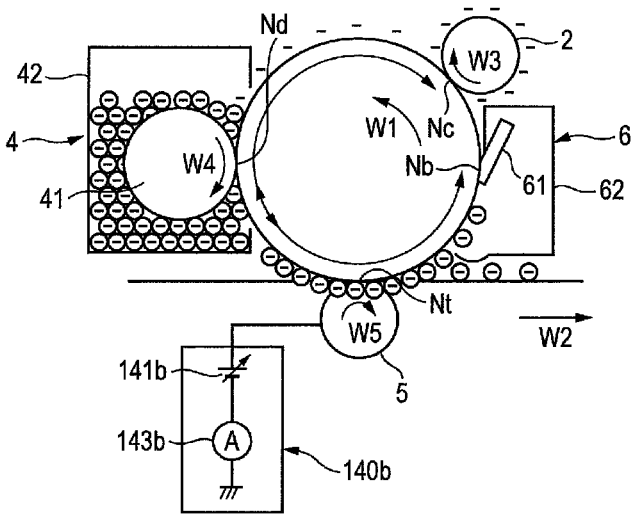
FIG. 14 is a schematic diagram of the image forming unit for describing movement of toner in a black image forming unit at the start of the initial operation in the third embodiment.

However, only the black image forming unit SK does not include a unit that applies primary transfer negative voltage in the image forming apparatus 100 of the present embodiment. Therefore, the primary transfer positive voltage and the primary transfer negative voltage are not applied to the black image forming unit SK, and the primary transfer roller 5K is controlled at 0 V. Therefore, the following occurs if the black image forming unit SK is in the development contact state at the start of the initial operation as illustrated in FIG. 14. More specifically, the toner moved to the photosensitive drum 1K is not affected by the electric field at the primary transfer portion Nt, and the toner is separated to the intermediate transfer belt 71 and the photosensitive drum 1K at the primary transfer portion Nt. The cleaning container 62K collects the toner moved to the photosensitive drum 1K. Meanwhile, the toner transferred to the intermediate transfer belt 71 is collected by the electrostatic cleaning system. More specifically, the toner transferred to the intermediate transfer belt 71 at the primary transfer portion Nt of the black image forming unit SK stays on the intermediate transfer belt 71 and moves, and the conductive brush 77 charges the toner to positive polarity. The toner reaches the photosensitive drum 1 (1Y, 1M, 1C or 1K) again, and the toner is collected in the cleaning container 62 (62Y, 62M, 62C or 62K). In this case, the toner can be sequentially allocated and collected in the cleaning containers 62 of a plurality of image forming units S as described later. If desired, a voltage of positive polarity may be applied to the primary transfer roller 5K of the black image forming unit SK at this point. In this case, the toner moved to the photosensitive drum 1K is actively transferred to the intermediate transfer belt 71. The toner is then collected as described above.

In the present embodiment, a time period of cleaning the intermediate transfer belt 71 by the electrostatic cleaning system can be changed according to the status between development contact and separation at the start of the initial operation. More specifically, if the black image forming unit SK is in the development separation state at the start of the initial operation, the toner does not move to the photosensitive drum 1K. Therefore, the toner is not transferred to the intermediate transfer belt 71, and the intermediate transfer belt 71 does not have to be cleaned by the electrostatic cleaning system. On the other hand, if the black image forming unit SK is in the development contact state at the start of the initial operation, the toner transferred to the intermediate transfer belt 71 needs to be collected by the electrostatic cleaning system.

Figure 15A:
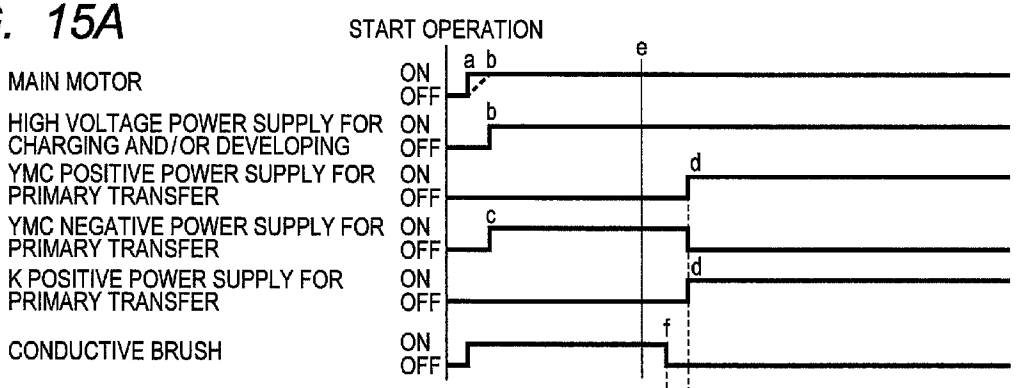
FIGS. 15A and 15B are timing chart diagrams at the start of the initial operation in the third embodiment.

More specific control of the initial operation according to the present embodiment will be described with reference to timing charts of FIGS. 15A and 15B. As described later, FIG. 15A is a timing chart when the black image forming unit SK is determined to be in the development separation state at the start of the initial operation. Meanwhile, as described later, FIG. 15B is a timing chart when the black image forming unit SK is determined to be in the development contact state at the start of the initial operation.

Figure 15B:
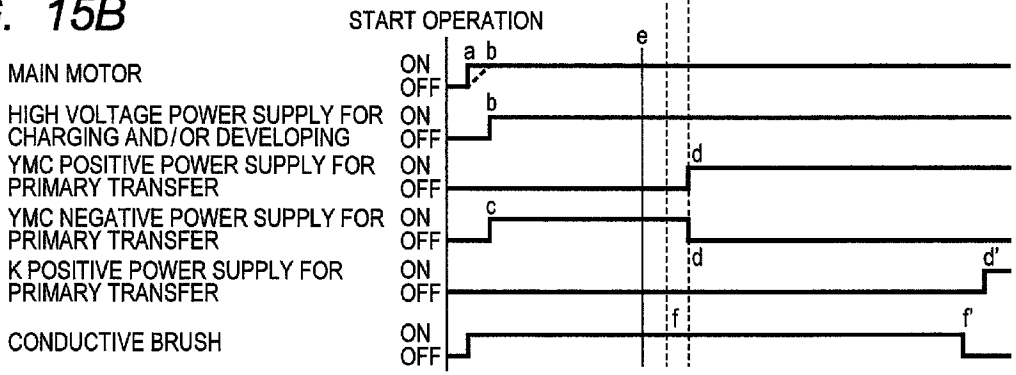

As illustrated in FIGS. 15A and 15B, when the main motor 111 is turned on at the timing a after the start of the initial operation, the cleaning high voltage power supply 78 is turned on at the same time in the present embodiment. After the start of the initial operation, the negative power supply 142*a* is turned on at the timing c (the same timing as the timing b in which the common power supply 130 is turned on) in the color image forming units SY, SM, SC and SK as in the first embodiment. Meanwhile, since the black image forming unit SK does not include the negative power supply, the power supply for primary transfer 140*b* remains to be off.

In the color image forming units SY, SM and SC, the negative power supply 142*a* is turned off at the timing d, and the positive power supply 141*a* is turned on as in the first embodiment.

A timing e in FIGS. 15A and 15B is a timing of taking the solenoid 163 twice. The status between development contact and separation at the start of the initial operation can be determined at the moment of the arrival of the timing e. The determination method will be further described later. The timing of turning off the cleaning voltage applied from the cleaning high voltage power supply 78 to the conductive brush 77 is determined based on the determination result of the status between development contact and separation at the start of the initial operation.

For example, if it is determined that the black image forming unit SK is in the development separation state at the start of the initial operation, the cleaning high voltage power supply 78 is turned off at a timing f as illustrated in FIG. 15A. Subsequently, when the image formation is ready (timing d) in the black image forming unit SK, the positive power supply 141*b* is turned on to prepare for the image formation.

On the other hand, the following is performed if the black image forming unit SK is determined to be in the development contact state at the start of the initial operation. More specifically, as illustrated in FIG. 15B, the time period of cleaning the intermediate transfer belt 71 based on the electrostatic cleaning system is extended compared to the case of FIG. 15A, and the cleaning high voltage power supply 78 is turned off at a timing f'. When the image formation is ready in the black image forming unit SK (timing d'), the positive power supply 141*b* is turned on to prepare for the image formation. The time period from the timing f to the timing f' in FIG. 15B is substantially equivalent to one cycle of the intermediate transfer belt 71 in the present embodiment. In this period, the toner on the intermediate transfer belt 71 charged to positive polarity by the conductive brush 77 is collected by the electrostatic cleaning system. In the present embodiment, the time period of collecting the toner on the intermediate transfer belt 71 by the electrostatic cleaning system (i.e. time period that the cleaning high voltage power supply 78 is turned on) is 15 sec (about two cycles of the intermediate transfer belt 71) in the development contact state illustrated in FIG. 15B. Meanwhile, the time period is 6 sec (equal to or less than one cycle of the intermediate transfer belt 71) in the development separation state illustrated in FIG. 15A.

In the example of FIGS. 15A and 15B, the toner transferred to the intermediate transfer belt 71 in the black image forming unit SK is charged by the conductive brush 76. The toner is mainly moved to the photosensitive drum 1Y in the yellow image forming unit SY and collected in the cleaning container 62Y. This is because the common positive power supply 141*a* applies the primary transfer positive voltage of the same polarity as the charged polarity of the toner charged by the conductive brush 76 to the primary transfer rollers 5Y, 5M and 5C in the color image forming units SY, SM and SC.

However, if the power supplies for primary transfer 140 are independently arranged for the color image forming units SY, SM and SC as in the first embodiment for example, the image forming unit S that is applied the primary transfer positive voltage can be arbitrarily changed between the timings d and d'. This is effective in sequentially allocating and collecting the toner transferred to the intermediate transfer belt 7 in the cleaning containers 62 of a plurality of image forming units S as described above.

For example, in FIG. 15B, the transfer voltage applied in the yellow image forming unit SY is switched from the primary transfer negative voltage to the primary transfer positive voltage in the period between the timings d and d', and the voltage is applied for a predetermined period and switched again to the primary transfer negative voltage. Substantially at the same time as the switch to the primary transfer negative voltage again in the yellow image forming unit SY, the transfer voltage applied in the magenta image forming unit SM is switched from the primary transfer negative voltage to the primary transfer positive voltage, and the voltage is applied for a predetermined period and switched again to the primary transfer negative voltage. Substantially at the same time as the switch to the primary transfer negative voltage again in the magenta image forming unit SM, the transfer voltage applied in the cyan image forming unit SC is switched from the primary transfer negative voltage to the primary transfer positive voltage, and the voltage is applied for a predetermined period and switched again to the primary transfer negative voltage. Substantially at the same time as the switch to the primary transfer negative voltage again in the cyan image forming unit SC, the application of the primary transfer positive voltage is started in the black image forming unit SK. For example, the application of the primary transfer positive voltage is started in all image forming units S at the timing d'. As a result, the toner transferred to the intermediate transfer belt 71 at the start of the initial operation can be sequentially allocated and collected in the cleaning containers 62Y, 62M, 62C and 62K of the yellow, magenta, cyan and black image forming units S based on the electrostatic cleaning system. This can prevent a situation that a disproportionately large amount of toner is collected in the cleaning container 62 of a specific image forming unit S, which leads to an earlier replacement of the process cartridge 120 of the image forming unit S.

The method of allocation is arbitrary, and the timing or the period of the start and stop of the application of the voltage in the image forming units S can be changed according to the configuration of the image forming apparatus 100. The arrangement is not limited to the allocation of the toner collected in the cleaning containers 62 of the plurality of image forming units S at the electrostatic cleaning in one initial operation. The image forming unit S that collects the toner may be changed every time the electrostatic cleaning is performed in the initial operation, and the toner collected in the cleaning containers 62 of the plurality of image forming units S may be allocated at the electrostatic cleaning in a plurality of initial operations. In this case, the primary transfer positive voltage can be selectively applied in the image forming unit S that collects the toner, in a predetermined period between the timings d and d'. Even if the toner is not actively allocated as described above, the toner on the intermediate transfer belt 71 may be collected in the cleaning container 62 of the plurality of image forming units S according to the amount of the toner. For example, part of the toner passing through the primary transfer portion NtY of the yellow image forming unit SY may be moved to the photosensitive drum 1M of the magenta image forming unit SM in the configuration of the power supply for primary transfer 140 as in the present embodiment. Part of the toner passing through the primary transfer portion NtM of the magenta image forming unit SM may be moved to the photosensitive drum 1C of the cyan image forming unit SC.

3. Control Mode and Control Flow

A control mode and a control flow of the image forming apparatus 100 in the present embodiment for realizing the control will be described.

Figure 16:
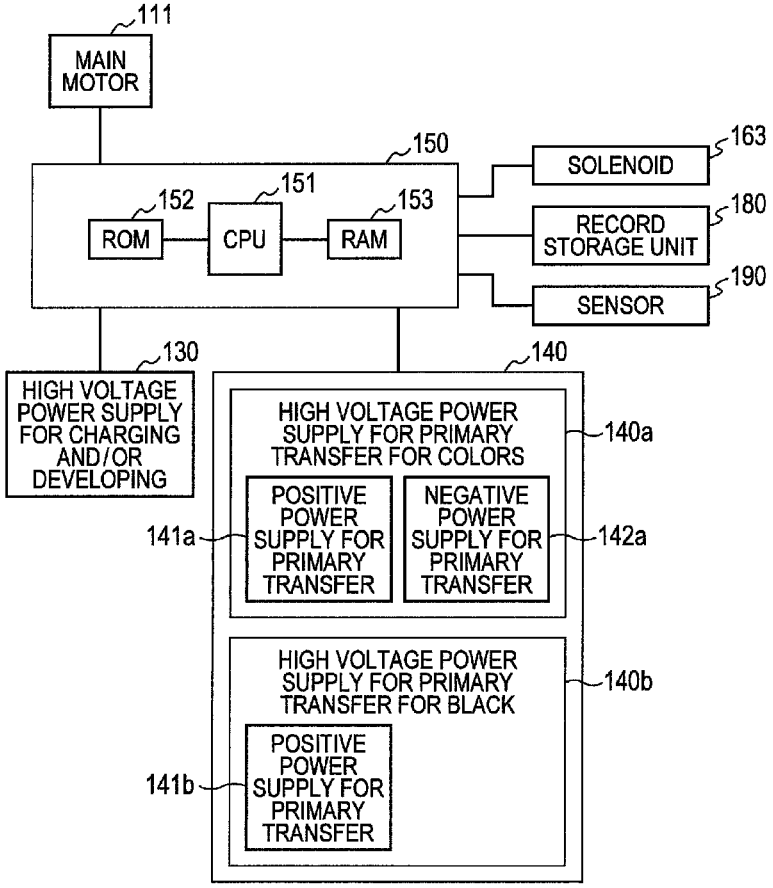
FIG. 16 is a block diagram illustrating a schematic control mode of main parts of the image forming apparatus according to the third embodiment.

FIG. 16 illustrates a schematic control mode of main parts of the image forming apparatus 100 of the present embodiment. Although the schematic control mode of main parts of the image forming apparatus 100 of the present embodiment is similar to that of the second embodiment illustrated in FIG. 10, the image forming apparatus 100 in the present embodiment further includes the sensor 190 that detects the cam position. In the image forming apparatus 100 of the present embodiment, the power supply for primary transfer 140 includes the power supply for primary transfer for colors 140*a* and the power supply for primary transfer for black 140*b*.

Figure 17:
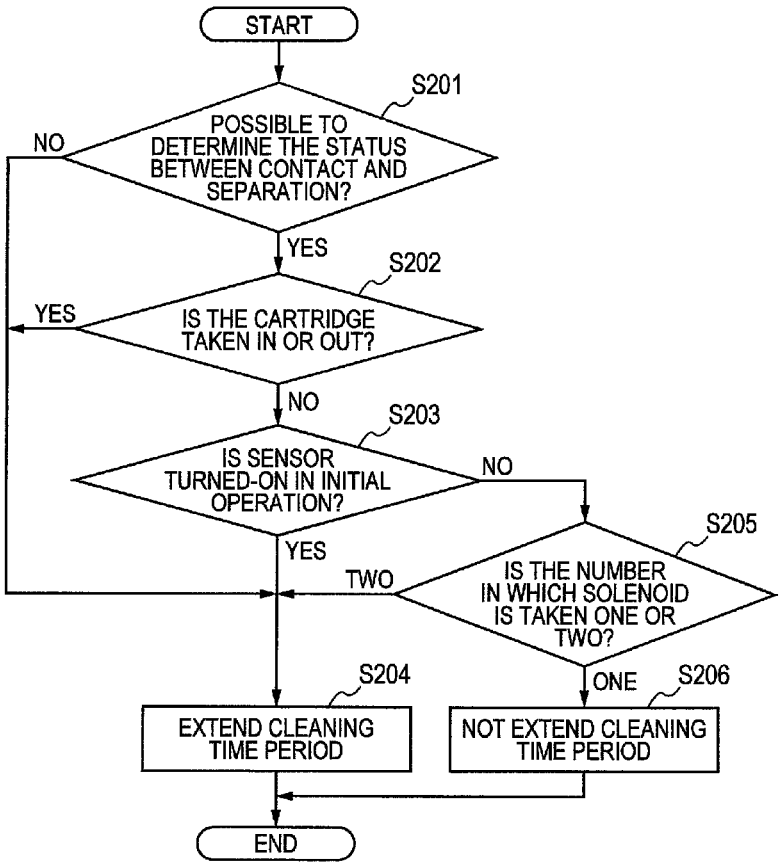
FIG. 17 is a flow diagram illustrating a schematic procedure of determination control of a status between contact and separation in the third embodiment.

FIG. 17 illustrates a schematic control flow of the determination of the status between development contact and separation at the start of the initial operation.

S201: The CPU 151 determines whether the status between development contact and separation can be accurately determined at the start of the initial operation. If the CPU 151 determines that the status between development contact and separation can be accurately determined (Yes), the CPU 151 proceeds to S202. Otherwise (No), the CPU 151 proceeds to S204. In this case, the power supply plug of the image forming apparatus 100 is pulled out from the socket, or there is a failure in the image forming apparatus 100, such as a jam and blackout, as described in the second embodiment. The CPU 151 assumes that the status between development contact and separation at the start of the initial operation is the "complete contact state".

S202: The CPU 151 determines whether the cartridge tray 170 is taken in or out based on the information of the record storage unit 180. If the CPU 151 determines that the cartridge tray 170 is taken in or out (Yes), the CPU 151 proceeds to S204. In this case, the CPU 151 can determine that the status between development contact and separation at the start of the initial operation is the "complete contact state". On the other hand, if the CPU 151 determines that the cartridge tray 170 is not taken in or out (No), the CPU 151 proceeds to S203.

S203: The CPU 151 determines whether the sensor 190 is turned on at the start of the initial operation. If the CPU 151 determines that the sensor 190 is turned on at the start of the initial operation (Yes), the CPU 151 proceeds to S204. In this case, the CPU 151 can determine that the status between development separation and contact at the start of the initial operation is the "complete contact state". On the other hand, if the CPU 151 determines that the sensor 190 is turned off at the start of the initial operation (No), the CPU 151 proceeds to S205.

S204: The CPU 151 determines to extend the time period of cleaning the intermediate transfer belt 71 based on the electrostatic cleaning system (turn off the cleaning voltage at the timing f'). Subsequently, the CPU 151 ends the process.

S205: The CPU 151 determines whether the sensor 190 is turned on when the solenoid 163 is taken once or the sensor 190 is turned on when the solenoid 163 is taken twice. If the CPU 151 determines that the sensor 190 is turned on when the solenoid 163 is taken once, the CPU 151 proceeds to S206. In this case, the CPU 151 can determine that the status between development contact and separation at the start of the initial operation is the "complete separation state". On the other hand, if the CPU 151 determines that the sensor 190 is turned on when the solenoid 163 is taken twice, the CPU 151 proceeds to S204. In this case, the CPU 151 can determine that the status between development contact and separation at the start of the initial operation is the "K contact state".

S206: The CPU 151 determines not to extend the time period of cleaning the intermediate transfer belt 71 based on the electrostatic cleaning system (turn off the cleaning voltage at the timing f). Subsequently, the CPU 151 ends the process.

In this way, the determination unit (CPU) 151 of the present embodiment determines the relative position of the developing unit 4 and the photosensitive member 1 of at least the second image forming unit SK among the first image forming units SY, SM, SC and the second image forming unit SK arranged in the movement direction of the rotary member 71. The image forming apparatus 100 of the present embodiment includes the cleaning unit 76 that removes the toner on the rotary member 71. The transfer power supply 140 of the first image forming unit SY, etc., can apply, to the transfer device 5, a voltage with opposite polarity to the charged polarity of the toner at the time of development and a voltage of the same polarity as the charged polarity of the toner at the time of development. In the first image forming unit SY, etc., at the start of the rotation of the photosensitive member 1, the transfer power supply 140 applies a voltage of the same polarity as the charged polarity of the toner at the time of development to the transfer device after the start of the output by the common power supply 130, before the charge area on the photosensitive member reaches the transfer portion Nt. Meanwhile, the transfer power supply 140 of the second image forming unit SK can apply, to the transfer device 5, only a voltage with opposite polarity to the charged polarity of the toner at the time of development. In the second image forming unit SK, at the start of the rotation of the photosensitive member, the transfer power supply 140 stops applying or applies, to the transfer device 5, a voltage with opposite polarity to the charged polarity of the toner at the time of development. In the present embodiment, the following is performed if the determination unit 151 determines that the relative position between the developing unit 4 and the photosensitive member 1 at the start of the rotation of the photosensitive member 1 in the second image forming unit SK is the first position. More specifically, the time period of using the cleaning unit 76 to clean the rotary member 71 after the start of the rotation of the photosensitive member 1 is extended, compared to when the determination unit 151 determines that the relative position is the second position. In the present embodiment, the determination unit 151 determines that the relative position between the developing unit 4 and the photosensitive member 1 is the first position if the relative position between the developing unit 4 and the photosensitive member 1 is actually the first position or if the relative position can be the first position at the start of the rotation of the photosensitive member 1.

Particularly, the cleaning unit 76 of the present embodiment includes the toner charging device (conductive brush) 77 that charges the toner on the rotary member to polarity opposite the charged polarity of the toner at the time of development. The toner charged by the toner charging device 77 is electrostatically moved to the photosensitive member 1 of the first image forming unit SY, etc., and/or the second image forming unit SK, and the toner is collected.

In the present embodiment, after the start of the rotation of the photosensitive members 1 in the first and second image forming units, the determination unit 151 determines whether the relative position between the developing unit 4 and the photosensitive member 1 at the start of the rotation of the photosensitive member 1 of at least the second image forming unit SK is the first position or the second position. Particularly, the movement unit 160 of the present embodiment sequentially and repeatedly switches the relative positions in the first and second image forming units, between the first position and the second position. In the present embodiment, the image forming apparatus 100 includes a detection unit 154 for detecting that the movement unit 160 is in a predetermined state for setting the relative positions in the first and second image forming units to predetermined positions. In the present embodiment, the movement unit 160 is driven after the start of the rotation of the photosensitive members 1 in the first and second image forming units, and the determination unit 151 determines the amount of drive of the movement unit 160 at the time of the detection of the predetermined state by the detection unit 154. The determination unit 151 determines the relative position at the start of the rotation of the photosensitive member 1 in at least the second image forming unit SK based on the amount of drive.

More specifically, the time period of cleaning the intermediate transfer belt 71 based on the electrostatic cleaning system is changed according to the status between the development contact and separation at the start of the initial operation in the present embodiment. As a result, the rotary members, such as the intermediate transfer belt 71 and the photosensitive drum 1, do not have to be excessively driven when the cleaning of the intermediate transfer belt 71 is not necessary, for example. This can prevent a failure caused by the transfer of the toner to the intermediate transfer belt 71 at the initial operation, and this can increase the lifetime of the key parts of the image forming apparatus 100, such as the photosensitive drum 1 and the intermediate transfer belt 71.

The reason that the initial operation when the developing roller contacts the photosensitive drum (color image forming unit) is started regardless of ON/OFF of the sensor 190 at the start of the initial operation as in the present embodiment is to reduce, as much as possible, the time period before the first image is output. If the status between development contact and separation can be accurately determined at the start of the initial operation and the cartridge tray 170 is not taken in or out as described above, one of the "complete separation state" and the "K contact state" can be determined by taking the solenoid 163 once or twice. However, if the operation is performed before the start of the initial operation, the time period before the output of the first image becomes long. Therefore, in the present embodiment, the state is assumed to be the "complete contact state" at first to start the initial operation when the developing roller contacts the photosensitive drum (color image forming unit), and the solenoid 163 is concurrently taken after the start of the initial operation. The length of the subsequent period of cleaning the intermediate transfer belt 71 based on the electrostatic cleaning system is determined according to the result. As a result, this can increase the opportunity of reducing, as much as possible, the time period before the first image is output.

As described, the image forming apparatus 100 includes the contact and separation unit 160 that can cause the developing roller 41 to be in contact with or separated from the photosensitive drum 1 in the present embodiment. In the present embodiment, at least one of the plurality of image forming units S does not include a unit that applies, to the primary transfer roller 5, a voltage of the same polarity as the charged polarity of the toner at the time of development. In the present embodiment, the image forming apparatus 100 can clean the intermediate transfer belt 71 based on the electrostatic cleaning system.

Among the plurality of image forming units S, the image forming unit S including the unit that applies, to the primary transfer roller 5, a voltage of the same polarity as the charged polarity of the toner at the time of development performs the following initial operation. More specifically, a voltage of the same polarity as the charged polarity of the toner at the time of development is applied to the primary transfer roller 5 after the start of the output of the common power supply 130, at least before the charge area on the photosensitive drum 1 reaches the primary transfer portion Nt. As a result, the toner on the photosensitive drum 1 can be collected in the photosensitive drum 1, without transferring the toner to the intermediate transfer belt 71 in the image forming unit. This can prevent staining the intermediate transfer belt 71 by the toner, and an excellent image can be provided.

On the other hand, in the image forming unit S not including the unit that applies, to the primary transfer roller 5, a voltage of the same polarity as the charged polarity of the toner at the time of development among the plurality of image forming units S, the toner may be transferred to the intermediate transfer belt 71 without passing through the primary transfer portion Nt at the start of the initial operation. In the present embodiment, the toner transferred to the intermediate transfer belt 71 is collected by the electrostatic cleaning system. In the present embodiment, the time period of cleaning the intermediate transfer belt 71 based on the electrostatic cleaning system can be changed according to the status between development contact and separation at the start of the initial operation. As a result, the intermediate transfer belt 71 can be appropriately cleaned based on the electrostatic cleaning system, only when the cleaning is necessary. In this way, an excellent image can be provided, and the lifetime of the image forming apparatus 100 can be increased.

Fourth Embodiment

Another embodiment of the present invention will be described. A basic configuration and operation of an image forming apparatus of the present embodiment are the same as those of the first to third embodiments. Therefore, the same or equivalent elements to those of the image forming apparatuses of the first to third embodiments are designated with the same reference numerals in the image forming apparatus of the present embodiment, and the detailed description will be omitted. The image forming apparatus 100 of the present embodiment particularly includes the contact and separation unit 160 as in the second embodiment.

1. Outline of Control

The image forming apparatus 100 of the present embodiment discharges the toner according to the printed sheet number to prevent turn-up of the drum cleaning blade 61.

The turn-up of the drum cleaning blade 61 denotes the following phenomenon. In the present embodiment, a tip (free end) of the drum cleaning blade 61 makes counter contact with the surface of the photosensitive drum 1 (the free end faces the upstream in the movement direction of the surface of the photosensitive member). An edge of the drum cleaning blade 61 in contact may not be able to entirely repel the force from the surface of the photosensitive drum 1 due to an increase in the frictional resistance, and the edge may turn up. This phenomenon will be called turn-up of the drum cleaning blade 61.

In the present embodiment, the drum cleaning blade 61 is made of polyurethane rubber that is a type of thermoplastic elastomer, in consideration of chemical resistance, abrasion resistance, formability and mechanical strength. However, if about 2000 images with a low image proportion (for example, image proportion per recording material of A4 size is 1%) are consecutively formed, the coefficient of friction between the photosensitive drum 1 and the drum cleaning blade 61 may significantly increase. The edge of the drum cleaning blade 61 may follow the rotation of the photosensitive drum 1, and this may lead to the turn-up of the drum cleaning blade 61.

The turn-up of the drum cleaning blade 61 is known to be correlated with the amount of toner staying at the edge section of the drum cleaning blade 61. More specifically, the toner staying at the edge section of the drum cleaning blade 61 can serve as a lubricant to reduce the friction force between the photosensitive drum 1 and the drum cleaning blade 61 to thereby prevent the turn-up of the drum cleaning blade 61. Therefore, toner to be sent to the drum cleaning blade 61 is discharged when the printed sheet number reaches 100 in the present embodiment.

In the present embodiment, the printed sheet number is sequentially added to and stored in a printed sheet number counter 154 (FIG. 18) including a non-volatile memory as a storage unit, every time printing is performed on the recording material P. In the present embodiment, the printed sheet number counter 154 accumulates and stores the printed sheet number for each of the image forming units SY, SM, SC and SK.

In the discharge operation of toner in the present embodiment, the exposure apparatus 3 is turned on for a predetermined time (200 ms in the present embodiment) while the main motor 111 is rotating and the common power supply 130 is turned on, and a toner image is formed on the photosensitive drum 1. The toner image is formed over the entire image formation area in the rotational axis direction of the photosensitive drum 1. The toner discharged on the photosensitive drum 1 is sent to the cleaning section Nb along with the rotation of the photosensitive drum 1. This prevents the turn-up of the drum cleaning blade 61.

In the first embodiment, the toner is sent to the cleaning sections Nb in all image forming units S if the initial operation is performed. In the second embodiment, the toner is sent to the cleaning sections Nb in all image forming units S if the initial operation when the developing roller contacts the photosensitive drum is performed in a state in which at least the status between development contact and separation can be accurately determined. In the third embodiment, the toner is sent to the cleaning sections Nb of all image forming units S if at least the status between development contact and separation can be accurately determined, the cartridge tray 170 is not taken in or out, and the state is determined to be the "complete contact state". Furthermore, in the third embodiment, the toner is sent to the cleaning section Nb in the black image forming unit SK if at least the status between development contact and separation can be accurately determined, the cartridge tray 170 is not taken in or out, and the state is determined to be the "K contact state".

Therefore, if the toner is sent to the cleaning section Nb in the initial operation, this can be assumed as the discharge of toner. As a result, the printed sheet number sequentially added and stored in the printed sheet number counter 154 is reset to 0 in such a case in the present embodiment.

Although the printed sheet number counter 154 is reset to 0 in the present embodiment, the count value may be reduced and changed by a predetermined value according to the amount of toner sent to the cleaning section Nb in the initial operation.

For example, it is assumed that in an image forming unit S, the initial operation is performed when the printed sheet number reaches 95, and the toner is sent to the cleaning section Nb as described above. In this case, the printed sheet number is reset for the image forming unit S, and the next discharge of toner is performed after 100 pieces are further printed.

In this way, the image forming apparatus 100 of the present embodiment includes: the cleaning member 61 that comes into contact with the photosensitive member 1 at the cleaning section Nb to remove the toner from the photosensitive member; and the accumulation unit 154 that accumulates the information related to the number of times the image forming operation is executed. The image forming apparatus 100 also includes an execution unit (CPU) 151 that executes the toner supply operation (discharge of toner) for supplying, to the cleaning section Nb, the toner supplied from the developing unit 4 to the photosensitive member 1 when the accumulated value of the accumulation unit 154 is equal to or greater than the predetermined value. In the present embodiment, the printed sheet number counter as the accumulation unit 154 accumulates the printed sheet number, and the toner supply operation (discharge of toner) is executed when the printer sheet number is 100 or greater. In the present embodiment, the image forming apparatus 100 further includes a changing unit (CPU) 151 that changes and reduces the accumulated value of the accumulation unit 154 in the following case. The changing unit 151 changes the accumulated value when the toner adhered to the photosensitive member passes through the transfer portion Nt and reaches the cleaning section Nb due to application of a voltage of the same polarity as the toner, at the start of the rotation of the photosensitive member 1. The toner is adhered between the section of the photosensitive member at the developing portion Nd and the charge area on the photosensitive member at the start of the output of the common power supply 130. Particularly, the changing unit 151 resets the accumulated value of the accumulation unit 154 in the present embodiment.

In other words, the frequency of the toner supply operation by the execution unit (CPU) 151 is changed according to the determination result of the determination unit (CPU) 151 that determines the relative position between the developing unit 4 and the photosensitive member 1 in the present embodiment. Particularly, the frequency is reduced when the determination unit 151 determines that the relative position between the actual developing unit 4 and the photosensitive member 1 at the start of the rotation of the photosensitive member 1 is the first position in the present embodiment.

2. Control Mode and Control Flow

A control mode and a schematic control flow of the image forming apparatus 100 according to the present embodiment for realizing the control will be described.

Figure 18:
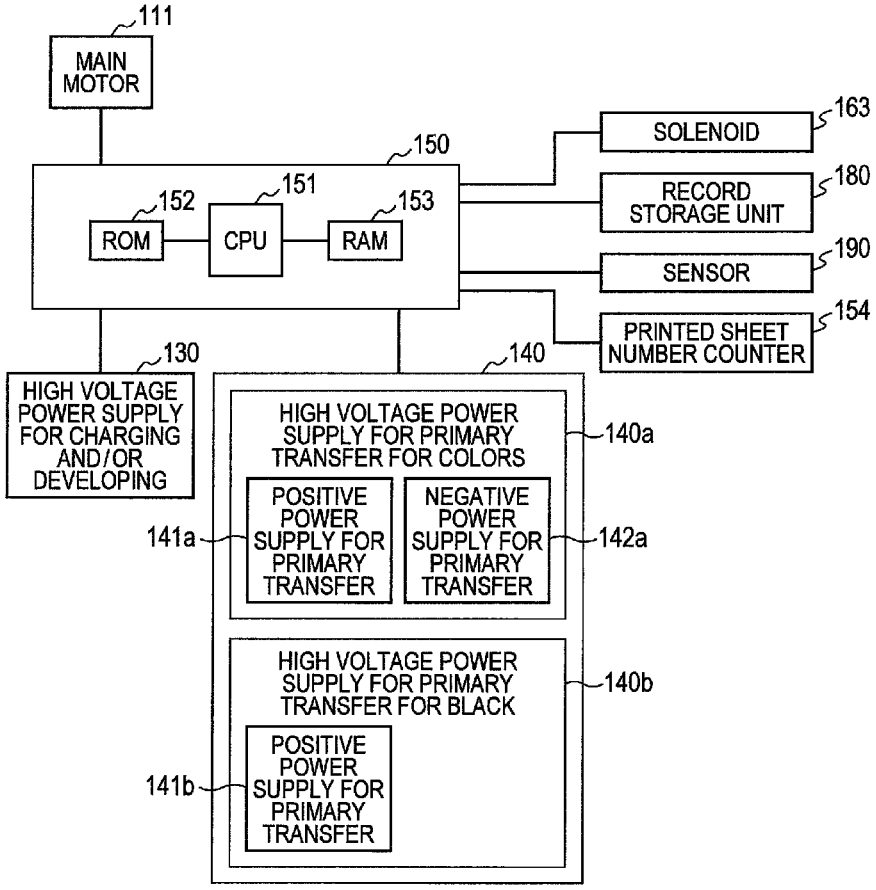
FIG. 18 is a block diagram illustrating a schematic control mode of main parts of an image forming apparatus according to a fourth embodiment.

FIG. 18 illustrates a schematic control mode of main parts of the image forming apparatus 100 according to the present embodiment. Although the schematic control mode of main parts of the image forming apparatus 100 according to the present embodiment can be similar to those of the first, second and third embodiments illustrated in FIGS. 3, 10 and 16, the image forming apparatus 100 of the present embodiment further includes the printed sheet number counter 154. FIG. 18 illustrates an example of the control mode in which the printed sheet number counter 154 is added to the control mode according to the third embodiment illustrated in FIG. 16.

Figure 19:
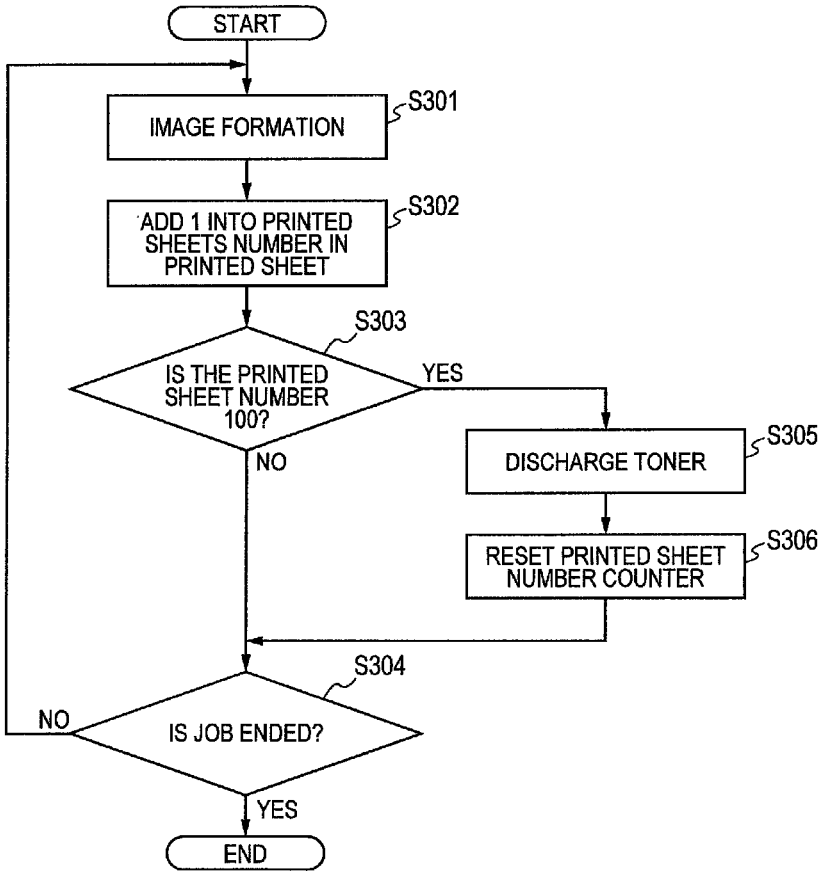
FIG. 19 is a flow diagram for describing a schematic control procedure of a print job in the fourth embodiment.

FIG. 19 illustrates a schematic control flow of a print job (a series of image forming operation on one or a plurality of recording materials based on one image formation start instruction).

S301: The CPU 151 starts image forming operation when a print signal (image formation start instruction) is input.

S302: The CPU 151 adds 1 to the printed sheet number stored in the printed sheet number counter 154 every time an image is formed on one piece of recording material P.

S303: The CPU 151 determines whether the count value of the printed sheet number counter 154 has reached 100. If the CPU 151 determines that the count value has not reached 100 (No), the CPU 151 proceeds to S304. On the other hand, if the CPU 151 determines that the count value has reached 100 (Yes), the CPU 151 proceeds to S305.

S304: The CPU 151 determines whether the entire printing of the print job is finished. If the CPU 151 determines that the entire printing is not finished (No), the CPU 151 returns to S301. If the CPU 151 determines that the entire printing is finished (Yes), the CPU 151 ends the process.

S305: The CPU 151 interrupts the print job to discharge the toner.

S306: The CPU 151 resets the count value of the printed sheet number counter 154 to 0 after the discharge of toner is finished. Subsequently, the CPU 151 proceeds to S304.

Figure 20:
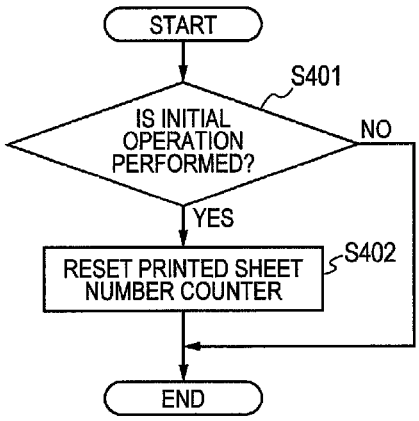
FIG. 20 is a flow diagram illustrating an example of a schematic control procedure of the initial operation in the fourth embodiment.

FIG. 20 illustrates a schematic control flow when the present embodiment is applied to the control of the initial operation in the first embodiment.

S401: The CPU 151 monitors whether the initial operation is performed. If the CPU 151 determines that the initial operation is performed (Yes), the CPU 151 proceeds to S402. If the CPU 151 determines that the initial operation is not performed (No), the CPU 151 ends the process.

S402: The CPU 151 resets the count value of the printed sheet number counter 154 to 0. Subsequently, the CPU 151 ends the process.

Figure 21:
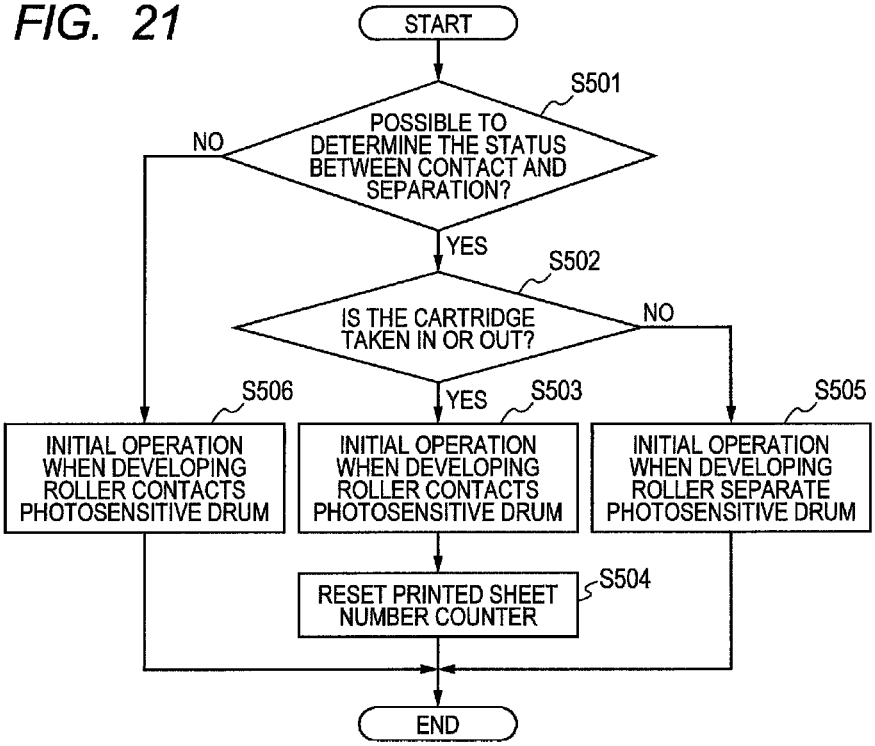
FIG. 21 is a flow diagram illustrating another example of the schematic control procedure of the initial operation in the fourth embodiment.

FIG. 21 illustrates a control flow when the present embodiment is applied to the control of the initial operation in the second embodiment.

S501: The CPU 151 determines whether the status between development contact and separation can be accurately determined at the start of the initial operation. If the CPU 151 determines that the status between development contact and separation can be accurately determined (Yes), the CPU 151 proceeds to S502. Otherwise (No), the CPU 151 proceeds to S506. In this case, the CPU 151 assumes that the state is the "development contact state". However, the state may not actually be the "development contact state" in this case. Therefore, it is not assumed that the toner is discharged.

S502: The CPU 151 determines whether the cartridge tray 170 is taken in or out based on the information of the record storage unit 180. If the CPU 151 determines that the cartridge tray 170 is taken in or out (Yes), the CPU 151 proceeds to S503. In this case, the CPU 151 can determine that the state is the "development contact state". Therefore, in this case, the CPU 151 can assume that the toner is discharged in the initial operation. On the other hand, if the CPU 151 determines that the cartridge tray 170 is not taken in or out (No), the process proceeds to S505. In this case, the CPU 151 can determine that the state is the "development separation state". Therefore, in this case, it can be determined that the toner is not discharged in the initial operation.

S503: The CPU 151 performs the initial operation when the developing roller contacts the photosensitive drum.

S504: The CPU 151 resets the count value of the printed sheet number counter 154 to 0. Subsequently, the CPU 151 ends the process.

S505: The CPU 151 performs the initial operation when the developing roller separates from the photosensitive drum. Subsequently, the CPU 151 ends the process.

S506: The CPU 151 performs the initial operation when the developing roller contacts the photosensitive drum. Subsequently, the CPU 151 ends the process.

Figure 22:
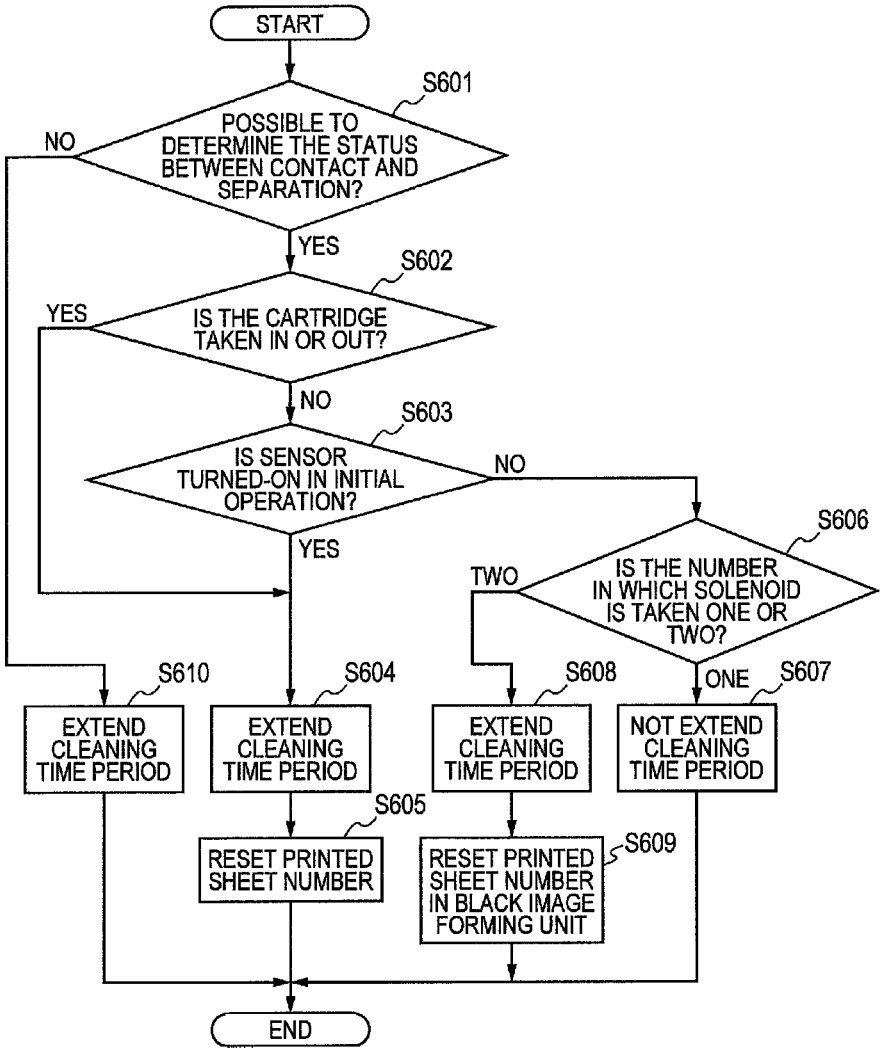
FIG. 22 is a flow diagram illustrating yet another example of the schematic control procedure of the initial operation in the fourth embodiment.

FIG. 22 illustrates a control flow when the present embodiment is applied to the control of the initial operation in the third embodiment.

S601: The CPU 151 determines whether the status between development contact and separation can be accurately determined at the start of the initial operation. If the CPU 151 determines that the status between development contact and separation can be accurately determined (Yes), the CPU 151 proceeds to S602. Otherwise (No), the CPU 151 proceeds to S610. In this case, the CPU 151 assumes that the status between development contact and separation at the start of the initial operation is the "complete contact state". However, the state may not actually be the "complete contact state". Therefore, the CPU 151 does not assume that the toner is discharged.

S602: The CPU 151 determines whether the cartridge tray 170 is taken in or out based on the information of the record storage unit 180. If the CPU 151 determines that the cartridge tray 170 is taken in or out (Yes), the CPU 151 proceeds to S604. In this case, the CPU 151 can determine that the status between development contact and separation at the start of the initial operation is the "complete contact state". Therefore, in this case, the CPU 151 can assume that the toner is discharged in all image forming units S in the initial operation. On the other hand, if the CPU 151 determines that the cartridge tray 170 is not taken in or out (No), the CPU 151 proceeds to S603.

S603: The CPU 151 determines whether the sensor 190 is turned on at the start of the initial operation. If the CPU 151 determines that the sensor 190 is turned on at the start of the initial operation (Yes), the CPU 151 proceeds to S604. In this case, the CPU 151 can determine that the status between development separation and contact at the start of the initial operation is the "complete contact state". Therefore, in this case, the CPU 151 can assume that the toner is discharged in all image forming units S in the initial operation. On the other hand, if the CPU 151 determines that the sensor 190 is turned off at the start of the initial operation (No), the CPU 151 proceeds to S606.

S604: The CPU 151 determines to extend the time period of cleaning the intermediate transfer belt 71 (turn off the cleaning voltage at the timing f') based on the electrostatic cleaning system.

S605: The CPU 151 resets the count value of the printed sheet number counter 154 to 0 in all image forming units S. Subsequently, the CPU 151 ends the process.

S606: The CPU 151 determines whether the sensor 190 is turned on when the solenoid 163 is taken once or the sensor 190 is turned on when the solenoid 163 is taken twice. If the CPU 151 determines that the sensor 190 is turned on when the solenoid 163 is taken once, the CPU 151 proceeds to S607. In this case, the CPU 151 can determine that the status between development contact and separation at the start of the initial operation is the "complete separation state". Therefore, in this case, the CPU 151 can determine that the toner is not discharged in the initial operation. On the other hand, if the CPU 151 determines that the sensor 190 is turned on when the solenoid 163 is taken twice, the CPU 151 proceeds to S608. In this case, the CPU 151 can determine that the status between development contact and separation at the start of the initial operation is the "K contact state". Therefore, in this case, the CPU 151 can assume that the toner is discharged in the black image forming unit SK in the initial operation.

S607: The CPU 151 determines not to extend the time period of cleaning the intermediate transfer belt 71 (turn off the cleaning voltage at the timing f) based on the electrostatic cleaning system. Subsequently, the CPU 151 ends the process.

S608: The CPU 151 determines to extend the time period of cleaning the intermediate transfer belt 71 (turn off the cleaning voltage at the timing f') based on the electrostatic cleaning system.

S609: The CPU 151 resets the count value of the printed sheet number counter 154 to 0 in the black image forming unit SK. Subsequently, the CPU 151 ends the process.

S610: The CPU 151 determines to extend the time period of cleaning the intermediate transfer belt 71 (turn off the cleaning voltage at the timing f') based on the electrostatic cleaning system. Subsequently, the CPU 151 ends the process.

As described, the image forming apparatus 100 discharges the toner to prevent the turn-up of the drum cleaning blade 61 in the present embodiment. In the present embodiment, the frequency of discharging the toner can be separately changed in consideration of the discharge of toner in the initial operation. According to the present embodiment, excessive consumption of toner at times other than the image formation can be prevented. The turn-up of the drum cleaning blade 61 can be prevented, and the lifetime of the process cartridge 120 can be increased.

Others

Although the specific embodiments of the present embodiment have been described, the present invention is not limited to the embodiments.

For example, the charging member, such as a charging roller, does not have to be in contact with the surface of the photosensitive member that is a charged body. As long as an electricity discharge available area determined by the gap voltage and the correction Paschen curve is surely guaranteed between the charging member and the photosensitive member, a non-contact close arrangement is possible with a gap (space) of several dozen μm, for example. The system of bringing the charging member in contact with or close to the charged body to charge the charged body by electricity discharge generated in a minute gap will be called a contact or close charging system or simply a contact charging system. The charging device is not limited to the one based on the contact or close charging system, and the charging device may be based on a corona charging system using corotron or scorotron well-known to those skilled in the art.

Although the intermediate transfer belt 71 is cleaned by the electrostatic cleaning system in the second and third embodiments, the intermediate transfer belt of the second and third embodiments may be cleaned by the belt cleaner as in the first embodiment, for example. In this case, the time period of rotating the intermediate transfer belt to clean the intermediate transfer belt by the belt cleaner can be changed according to the status between development contact and separation at the start of the initial operation as in the control described above.

The cases in which the developing unit comes into contact with or separated from the photosensitive member have been particularly described in the second and third embodiments. However, the second and third embodiments can be similarly applied when the developing unit is movable between a first position closer to the photosensitive member and a second position farther from photosensitive member. For example, if the toner moves from the developing unit to the non-charge area on the photosensitive member at the first position but does not move to the non-charge area at the second position, the entire description can be applied by interpreting the contact in the second and third embodiments as the first position and interpreting the separation as the second position.

Figure 23:
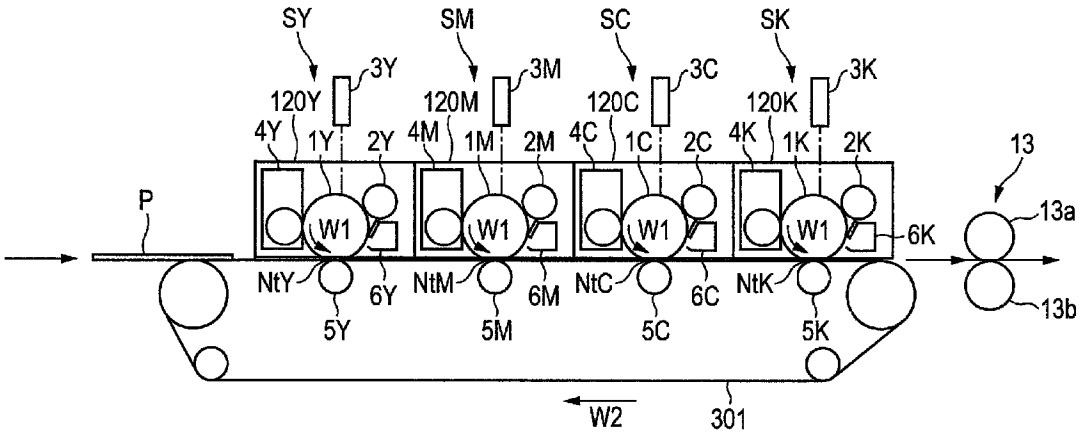
FIG. 23 is a schematic cross-sectional view of main parts of the image forming apparatus for describing another mode of the image forming apparatus in which the present invention can be applied.
Figure 24A:
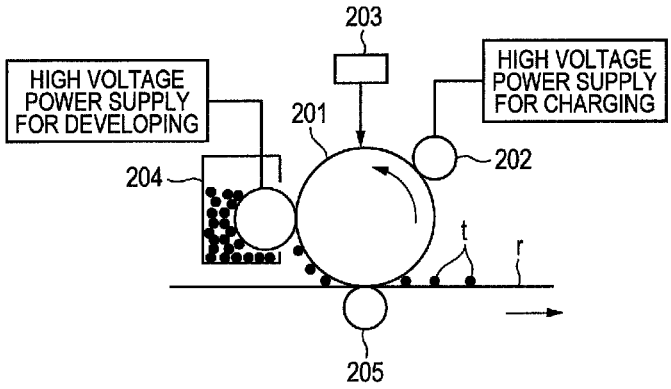
Prior Art FIG. 24A
FIGS. 24A and 24B are schematic diagrams illustrating a configuration of the surrounding of a photosensitive drum in a conventional image forming apparatus.
Figure 24B:
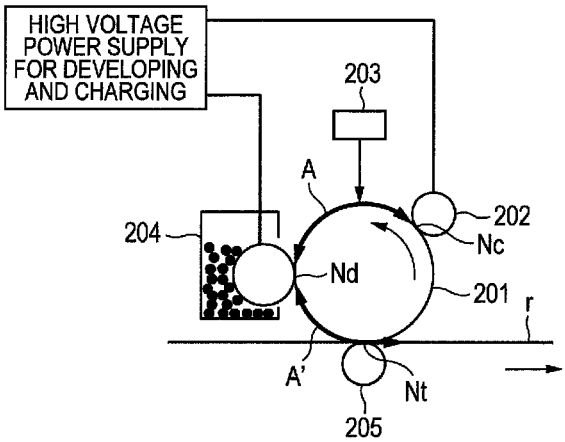
Prior Art FIG. 24B

The image forming apparatus is not limited to the in-line image forming apparatus using the intermediate transfer member. The present invention can be equally applied if the image forming apparatus includes the transfer device that transfers the toner image on the photosensitive member to the rotary member that comes into contact with the photosensitive member to move, and the same advantageous effects can be attained. For example, a rotary image forming apparatus including a belt-type intermediate transfer member or an image forming apparatus using a recording material carrier, such as a transfer belt that directly carries and conveys recording material such as paper, can also be applied. For example, FIG. 23 illustrates a schematic configuration of main parts of an example of an image forming apparatus of a direct transfer system. In FIG. 23, the elements with the same or corresponding functions and configurations to the image forming apparatus of the intermediate transfer system illustrated in FIG. 1 are designated with the same reference numerals. The image forming apparatus of the direct transfer system includes, for example, an endless transfer belt 301 as a recording material carrier, in place of the intermediate transfer member of the image forming apparatus of the intermediate transfer system. The recording material carrier is a movable rotary member that conveys the recording material P to which the toner image is transferred. The image forming apparatus further includes, for example, a transfer roller 5 as a transfer device corresponding to the primary transfer device of the image forming apparatus of the intermediate transfer system. The toner images formed on the photosensitive drums 1 in the image forming units S are sequentially superimposed and transferred at the transfer portions Nt on the recording material P carried and conveyed by the transfer belt 301. In the image forming apparatus of the direct transfer system, the toner moved to the photosensitive member may be transferred to the recording material carrier at the start of the initial operation if a common power supply of the charging device and the developing unit applies voltage in each image forming unit. As a result, the toner may be adhered to the recording material to cause a defect in the image. Therefore, the present invention can be applied to attain the same advantageous effects in the image forming apparatus of the direct transfer system.

The image forming apparatus is not limited to the color image forming apparatus, but can be a single-color image forming apparatus of black, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-265760, filed on Dec. 4, 2012, which is hereby incorporated by reference herein in its entirety.

What is claimed is:

1. An image forming apparatus comprising:

a rotatable photosensitive member;

a charging device that charges the photosensitive member;

an exposure device that exposes the charged photosensitive member to form an electrostatic latent image on the photosensitive member;

a developing device that supplies toner to the photosensitive member to develop an electrostatic latent image on the photosensitive member as a toner image;

a common power supply that applies voltage to the charging device and the developing device;

a movable rotary member that forms a transfer portion with the photosensitive member to receive the toner image from the photosensitive member or to convey a recording material that receives the toner image;

a moving unit that effects relative movement between the developing device and the photosensitive member between a first position for developing the electrostatic latent image and a second position in which the developing device is further away from the photosensitive member than in the first position;

a determination unit that determines whether a relative position when the photosensitive member starts rotating is the first position or the second position;

and a control unit configured to perform a control of potential at the transfer portion, wherein in a case where the determination unit determines that the relative position when the photosensitive member starts rotating is the first position, during a period after the common power supply starts outputting and before a charge area charged by the charging device on the photosensitive member reaches the transfer portion, the control unit controls the potential at the transfer portion to be a potential of a same polarity as a charged polarity of the toner.

2. An image forming apparatus according to claim 1, further comprising a transfer device that is arranged corresponding to the photosensitive member and applies voltage from a transfer power supply, wherein when the photosensitive member starts rotating, during a period after the common power supply starts outputting and before a charge area charged by the charging device on the photosensitive member reaches the transfer portion, the control unit controls the transfer power supply to apply a voltage of the same polarity to the transfer device.

3. An image forming apparatus according to claim 2, wherein after the photosensitive member starts rotating, and just after the charge area charged by the charging device on the photosensitive member reaches the transfer portion, the control unit stops applying the voltage of the same polarity to the transfer device.

4. An image forming apparatus according to claim 2, wherein if the determination unit determines that the relative position when the photosensitive member starts rotating is the first position, the control unit controls the transfer power supply to apply the voltage of the same polarity to the transfer device when the photosensitive member starts rotating.

5. An image forming apparatus according to claim 4, wherein if the determination unit determines that the relative position when the photosensitive member starts rotating is the second position, the moving unit maintains the relative position at the second position after the photosensitive member starts rotating, and until the charge area charged by the charging device on the photosensitive member reaches the transfer portion.

6. An image forming apparatus according to claim 1, wherein the determination unit also determines that the relative position is the first position in a case where the relative position can be the first position.

7. An image forming apparatus according to claim 1, further comprising:

a cleaning member that comes into contact with the photosensitive member at a cleaning section to remove the toner from the photosensitive member, wherein when the rotation of the photosensitive member starts rotating, in a case where the toner adhered to a non-charged area on the photosensitive member from the developing device passes through the transfer portion and reaches the cleaning section, the cleaning member removes the adhered toner from the photosensitive member.

8. An image forming apparatus according to claim 7, further comprising:

an accumulation unit that accumulates information related to the number of times an image forming operation is executed, wherein the control unit can execute a toner supply mode for supplying, to the cleaning section, the toner supplied to the photosensitive member from the developing device in a case where an accumulated value of the accumulation unit is equal to or greater than a predetermined value, and the control unit can reduce the accumulated value of the accumulation unit.

9. An image forming apparatus according to claim 8, wherein the control unit is capable of resetting the accumulated value of the accumulation unit.

10. An image forming apparatus according to claim 7, wherein the control unit is capable of executing a toner supply mode for supplying, to the cleaning section, the toner supplied from the developing device to the photosensitive member according to a number of times an image forming operation is executed, and the control unit postpones the execution of the toner supply mode if the determination unit determines that the relative position at the start of the rotation of the photosensitive member is the first position.

11. An image forming apparatus according to claim 1, wherein the rotary member is an intermediate transfer member that carries and conveys the toner image transferred from the photosensitive member to transfer the toner image to the recording material.

12. An image forming apparatus according to claim 1, wherein the rotary member is a recording material carrier that carries and conveys the recording material that receives the toner image from the photosensitive member.

13. An image forming apparatus according to claim 1, further comprising a charging unit configured to charge the movable rotary member, wherein the control of potential at the transfer portion is effected by charging the movable rotary member with the charging unit.

* * * * *